US006966915B2

(12) United States Patent
Inoue et al.

(10) Patent No.: US 6,966,915 B2
(45) Date of Patent: Nov. 22, 2005

(54) DEPILATING DEVICE

(75) Inventors: Tomoyuki Inoue, Hikone (JP); Hidekazu Sueyoshi, Kanzaki-gun (JP)

(73) Assignee: Matsushita Electric Works, Ltd., Kadoma (JP)

( * ) Notice: Subject to any disclaimer, the term of this patent is extended or adjusted under 35 U.S.C. 154(b) by 585 days.

(21) Appl. No.: 10/155,125

(22) Filed: May 28, 2002

(65) Prior Publication Data

US 2003/0009856 A1 Jan. 16, 2003

(30) Foreign Application Priority Data

May 28, 2001 (JP) ..... 2001-158305

(51) Int. Cl.[7] ..... A45D 26/00
(52) U.S. Cl. ..... 606/133; 19/2
(58) Field of Search ..... 606/133, 131; 19/2

(56) References Cited

U.S. PATENT DOCUMENTS 5,346,499 A 9/1994 Garenfeld et al.
5,857,903 A 1/1999 Ramspeck et al.
5,916,222 A * 6/1999 Iwasaki et al. ..... 606/133
6,045,559 A * 4/2000 Sueyoshi et al. ..... 606/133
6,669,704 B2 * 12/2003 Inoue et al. ..... 606/133
6,730,100 B2 * 5/2004 Yamaguchi et al. ..... 606/133

FOREIGN PATENT DOCUMENTS

| | | |
|---|---|---|
| EP | 1 046 355 | 10/2000 |
| FR | 2 690 819 | 11/1993 |
| JP | 02-029208 | 1/1990 |
| JP | 02-215406 | 8/1990 |
| JP | 03-030706 | 2/1991 |

* cited by examiner

*Primary Examiner*—Tan Uyen
(74) *Attorney, Agent, or Firm*—Oblon, Spivak, McClelland, Maier & Neustadt, P.C.

(57) ABSTRACT

A depilating device includes at least one pair of depilating claws which are provided on a circumferential surface of at least one rotating cylinder and which are configured to open and close to pinch and pull out hair due to a rotation of the at least one rotating cylinder. A plate has an outer surface and inner surface which is configured to face the circumferential surface of the at least one rotating cylinder and has at least one slit through which the hair passes toward the circumferential surface of the at least one rotating cylinder. The slit extends along a substantially rotational direction of the at least one rotating cylinder.

30 Claims, 23 Drawing Sheets

DEPILATING DEVICE

CROSS-REFERENCE TO RELATED APPLICATIONS

The present application claims priority to Japanese Patent Application No. 2001-158305, filed May 28, 2001. The contents of that application are incorporated herein by reference in their entirety.

BACKGROUND OF THE INVENTION

1. Field of the Invention

The present invention relates to a depilating device.

2. Discussion of the Background

Japanese Unexamined Patent Publications (KOKAI) Nos. 2-29208 and 2-215406 disclose a depilating device. The contents of these applications are incorporated herein by reference in their entirety. In this depilating device, depilating rollers are covered by a plate. The plate includes slits which extend along a rotational axial direction of the depilating rollers.

Japanese Unexamined Patent Publication (KOKAI) No. 3-30706 discloses a depilating device. The contents of this application are incorporated herein by reference in their entirety. In this depilating device, depilating rollers are covered by a plate. The plate includes slits which has a waveform.

SUMMARY OF THE INVENTION

According to one aspect of the present invention, a depilating device includes at least one pair of depilating claws which are provided on a circumferential surface of at least one rotating cylinder and which are configured to open and close to pinch and pull out hair due to a rotation of the at least one rotating cylinder. A plate has an outer surface and inner surface which is configured to face the circumferential surface of the at least one rotating cylinder and has at least one slit through which the hair passes toward the circumferential surface of the at least one rotating cylinder. The slit extends along a substantially rotational direction of the at least one rotating cylinder.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
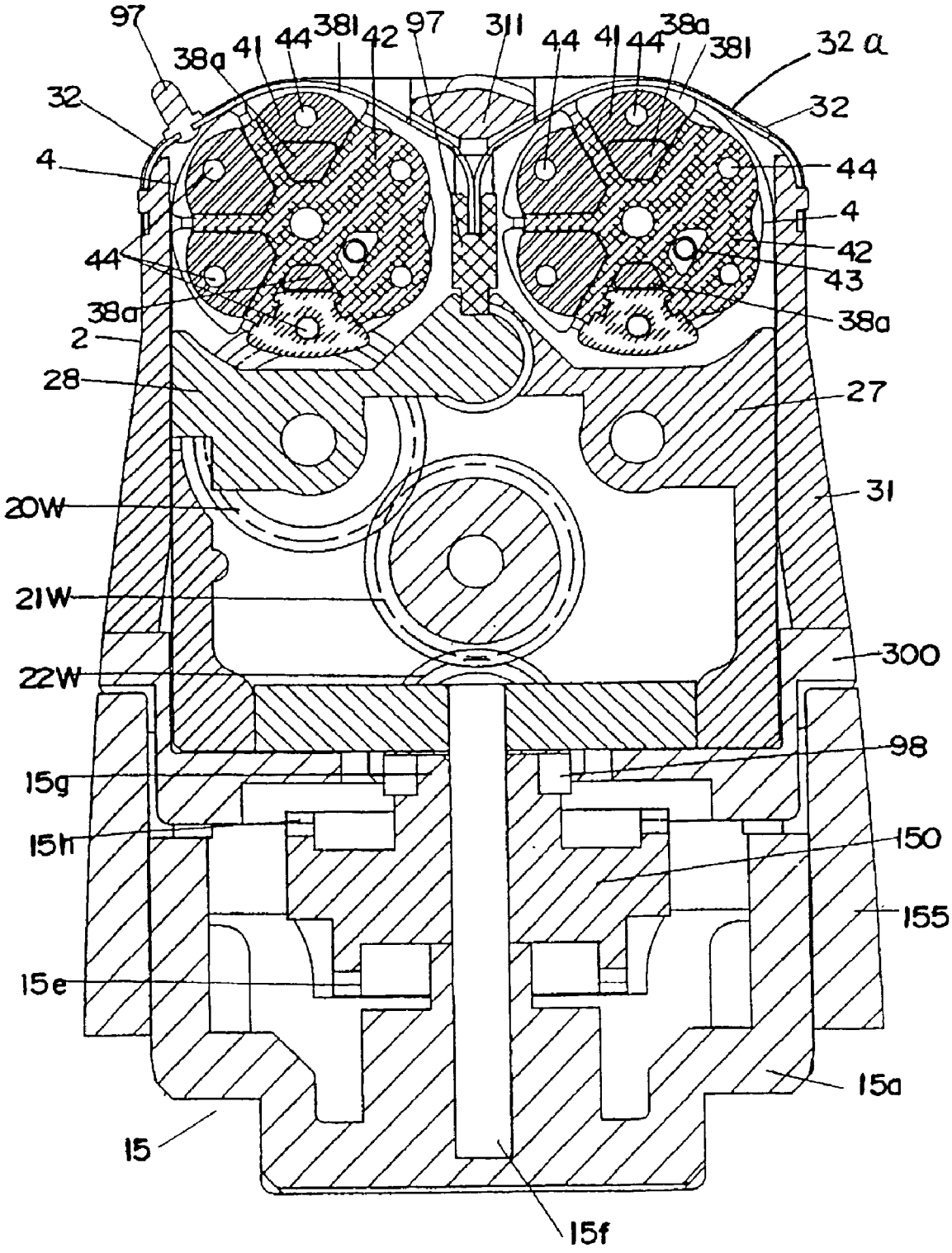
FIG. 1 is a longitudinal section view of a depilation head according to an embodiment of the invention.
Figure 2:
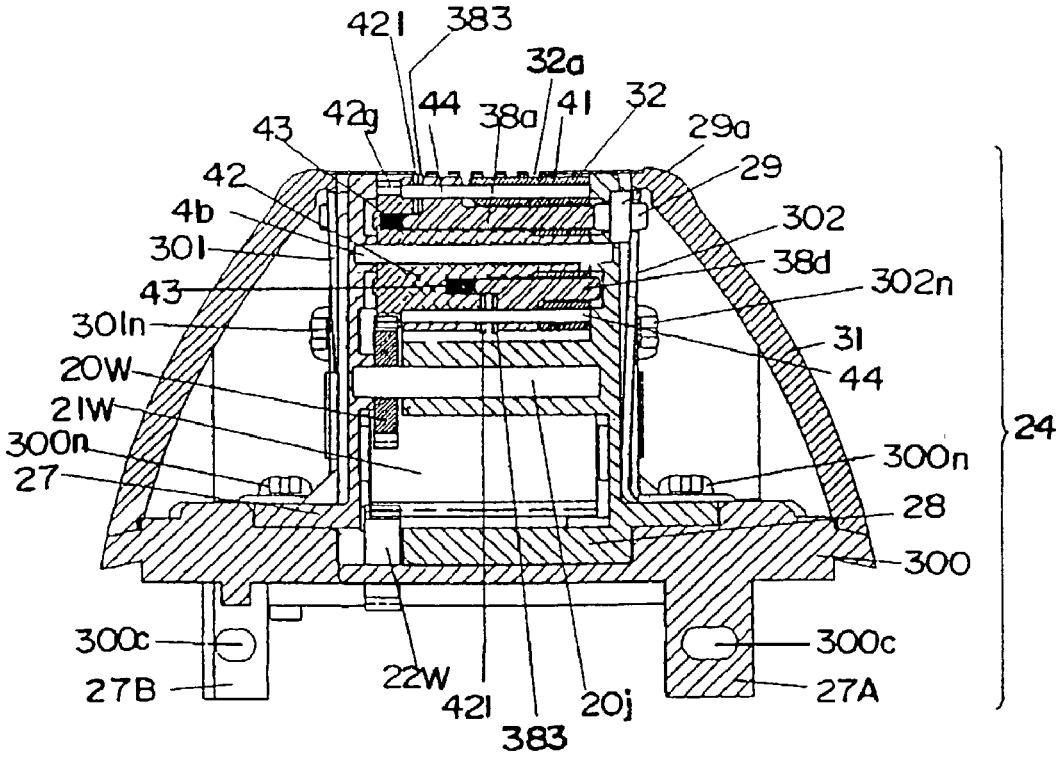
FIG. 2 is a cross-sectional view of the depilation block according to the embodiment of the invention.
Figure 3:
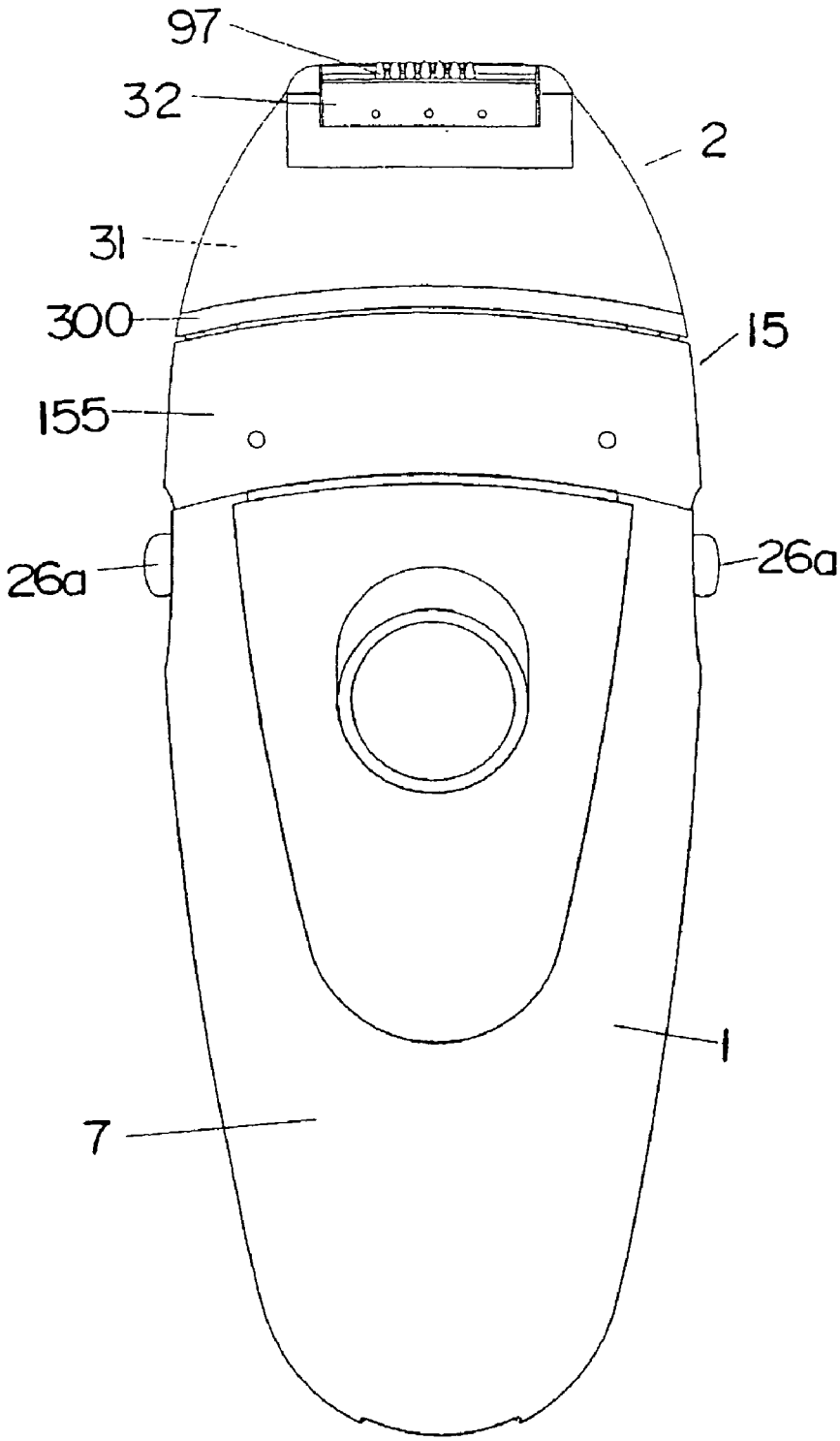
FIG. 3 is a front view showing an entire structure of a depilating device according to the embodiment of the invention.

The embodiments will now be described with reference to the accompanying drawings, wherein like reference numerals designate corresponding or identical elements throughout the various drawings.

Embodiments will now be described with reference to the accompanying drawings. As shown in FIGS. 1 to 6, a depilating device according to an embodiment of the present invention shown in the drawings is formed in the size that can be grasped in a hand. The depilating device includes a housing 1 containing a motor 3 as a driving unit. A depilation head 2 equipped with a rotating cylinder 4 is attached to the housing 1. A depilation section includes two or more claws (421, 383) that open and close to pinch hairs as the rotating cylinder 4 rotates. The depilation section thus pinches and pulls out hairs from the skin as the rotating cylinder 4 rotates.

Figure 7:
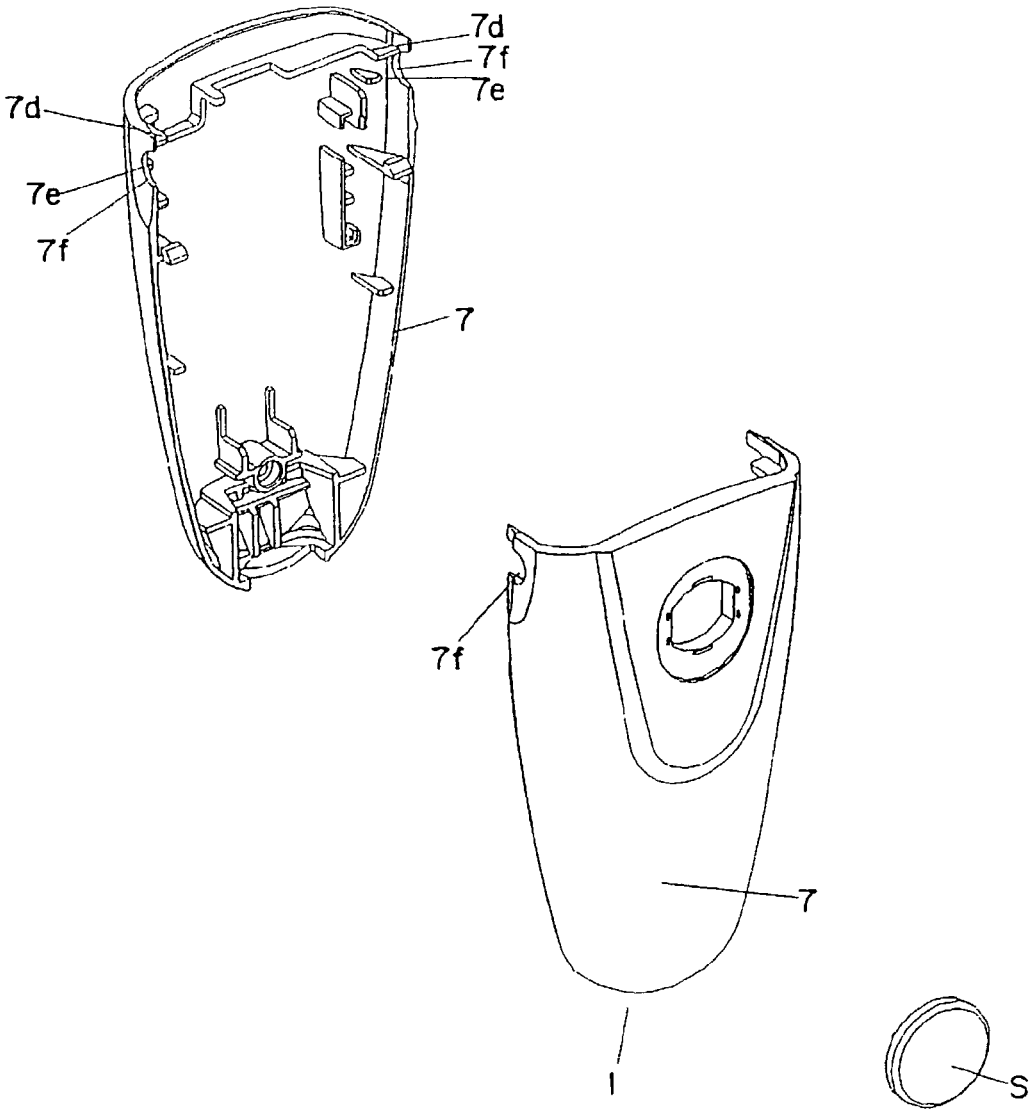
FIG. 7 is a disassembled perspective view of a housing according to the embodiment of the invention.
Figure 8:
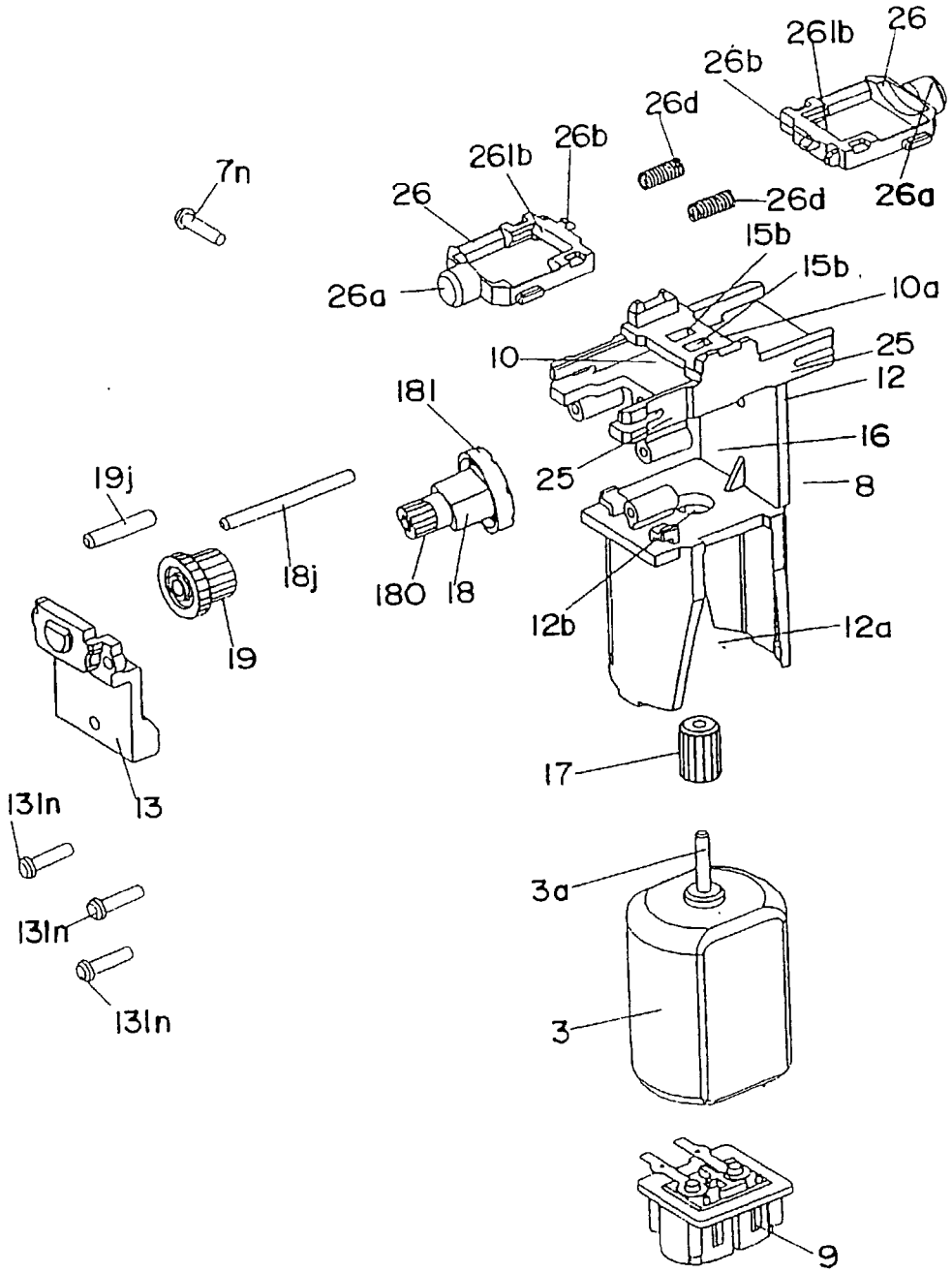
FIG. 8 is a disassembled perspective view of components in the housing according to the embodiment of the invention.

Referring to FIGS. 7 and 8, the housing 1 has two half housings 7, 7 joined by a screw (7*n*), and has a switch (S) in its front face. The motor 3 and a drive transmission section are provided in a base 8. The base 8 is provided in the housing 1, and a top-face section of the base 8 partitions an upper part of the housing 1. A plug 9 for electric supply is provided in a bottom of the housing 1. Alternatively, a battery may be accommodated in the housing 1 for a power source.

The top face of the base 8 has a hook connection 10. The base 8 has a base portion 12 for accommodating the motor 3, and a cover 13 fixed to a side opening of the base portion 12 by screws (131*n*). An interior section (12*a*) is provided in a lower part of the base portion 12. The motor 3 is inserted in the interior section (12*a*) from the lower part of the interior section (12*a*). A gear 18 and a gear 19 are provided in a space 16 provided in an upper part of the base portion 12 in which the side opening is covered by the cover 13. The base portion 12 is fixed inside the housing 1 by fitting a support frame 25 of the base portion 12 between projections (7*d*, 7*e*).

The gear 18 attached to the base 8 by a shaft (18*j*) includes a face gear 181 and a pinion 180. The gear 19 supported by a shaft (19*j*) meshes with the pinion 180. An output shaft (3*a*) of the motor 3 which is fixed in the interior section (12*a*) extends to the space 16 through a hole (12*b*) of the interior section (12*a*). Since a pinion 17 fixed to a portion of the output shaft (3*a*) located in the space 16 meshes with the face gear 181, the rotation of the motor 3 is transmitted to the gear 19 through the pinion 17 and the gear 18. Subsequently, the gear 19 drives the rotating cylinder 4 of the depilation head 2, as explained later.

The hook connection 10 has a projection (10*a*) forming a tunnel configuration in the center of the top face of the base portion 12, and a pair of slide frames 26, 26. The top face of the projection (10*a*) has holes (15*b*, 15*b*).

Each slide frame 26 is substantially rectangular in a plan view thereof and has a controlling element (26*a*) projecting from one side of the slide frame 26 toward outside. Each of slide frames 26, 26 also has a support hook (261*b*) projecting from an inner surface of another side of the slide frame 26. Each slide frame 26 has a projection (26*b*) projecting from the another side upwardly. The slide frames 26, 26 are slidably engaged in the tunnel configuration of the projection (10*a*) as the projections (26*b*, 26*b*) are inserted in the holes (15*b*, 15*b*), respectively, such that the projections (26*b*, 26*b*) are slidably engaged in the holes (15*b*, 15*b*). The projections (26*b*, 26*b*) abut against the edges of the holes (15*b*, 15*b*) so that the slide frames 26, 26 are prevented from disengaging from the projections (10*a*, 10*a*). Between the slide frames 26, 26, springs (26*d*, 26*d*) are provided in the tunnel configuration and elastically urge the slide frames 26, 26 away from each other. The controlling elements (26*a*, 26*a*) of the slide frames 26, 26 project toward outside of the housing 1 through holes (7*f*, 7*f*) formed in the housing 1.

Figure 9:
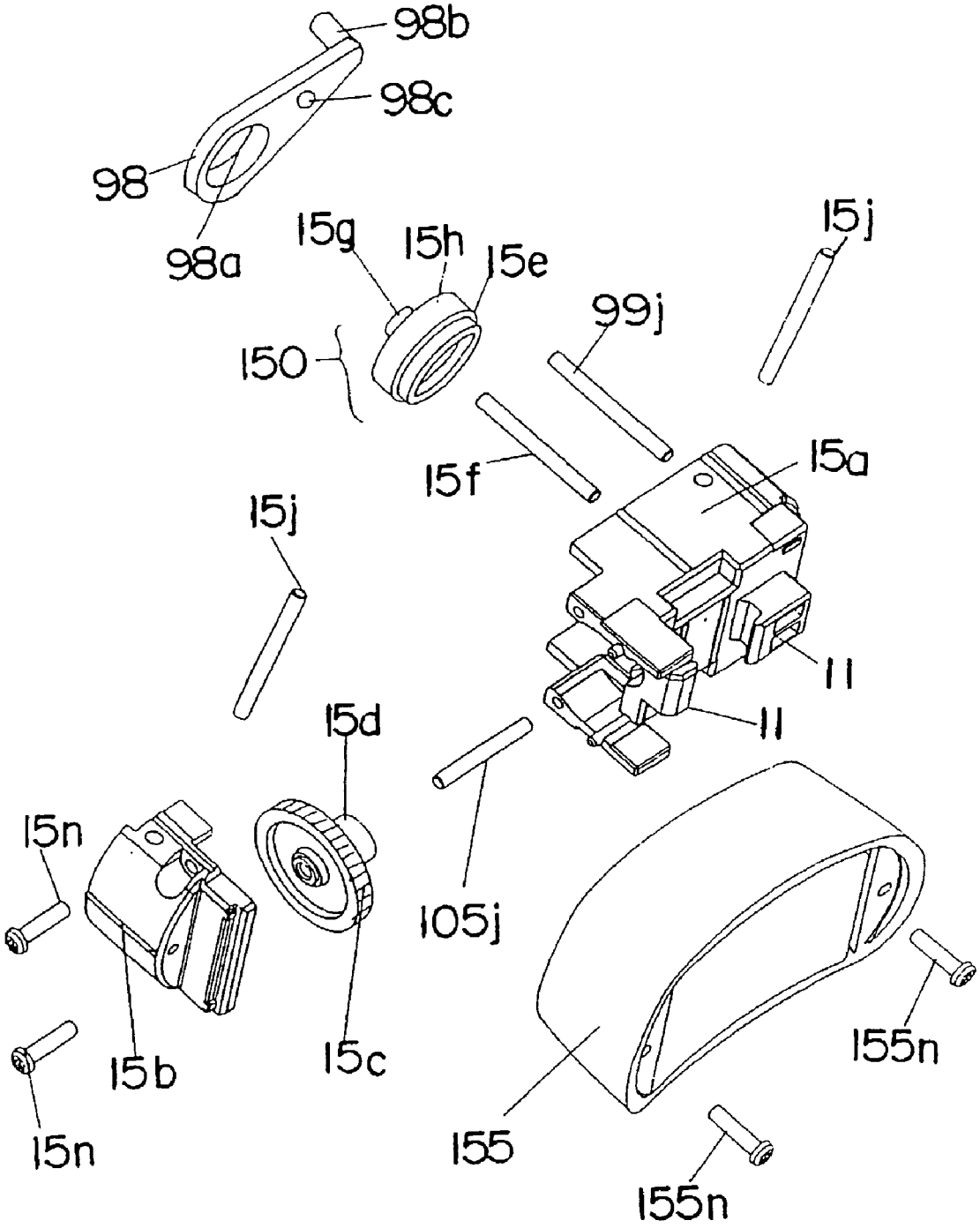
FIG. 9 is a disassembled perspective view of a base block according to the embodiment of the invention.
Figure 10:
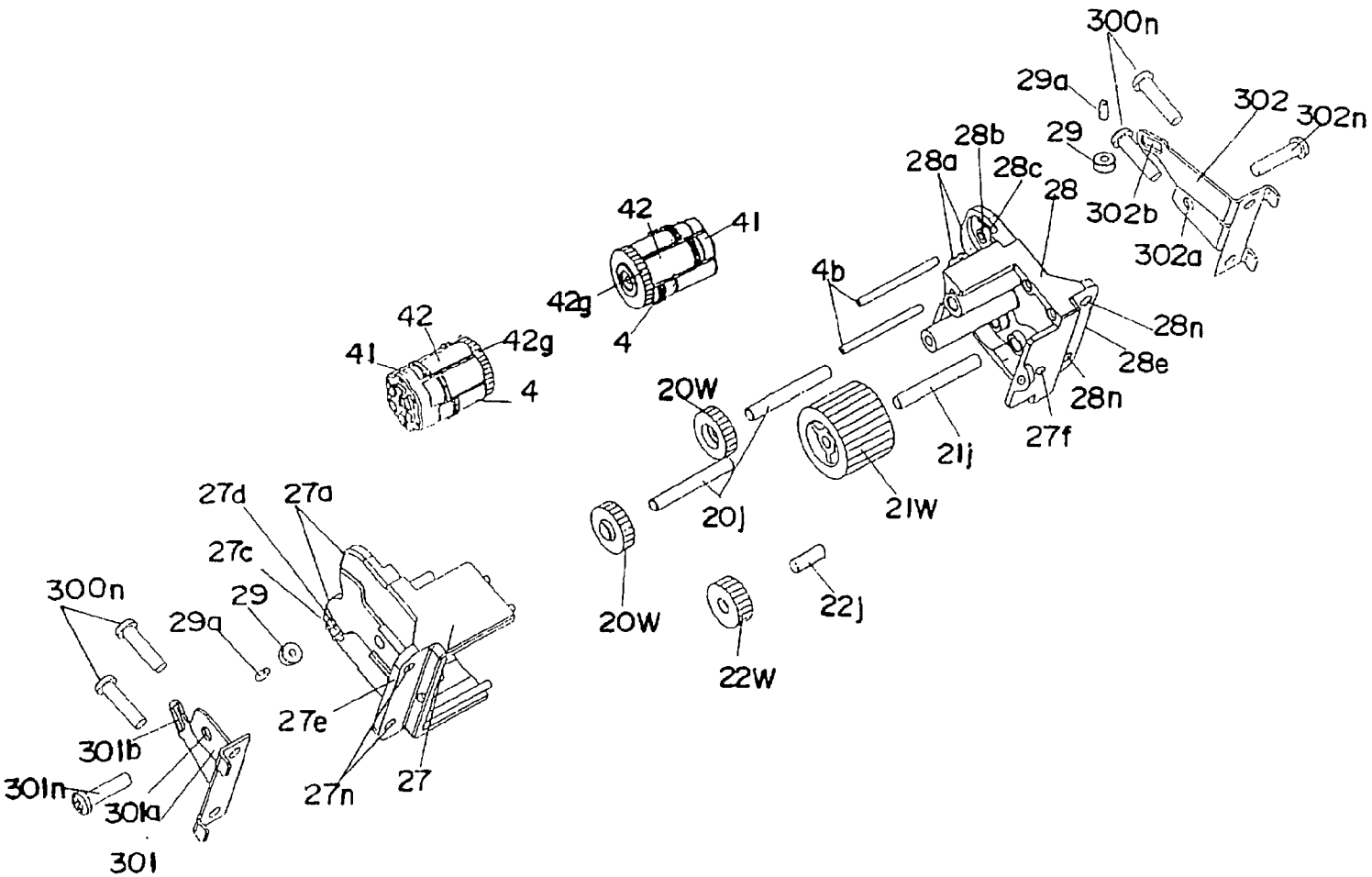
FIG. 10 is a disassembled perspective view of the depilation block according to the first embodiment of the invention.
Figure 11:
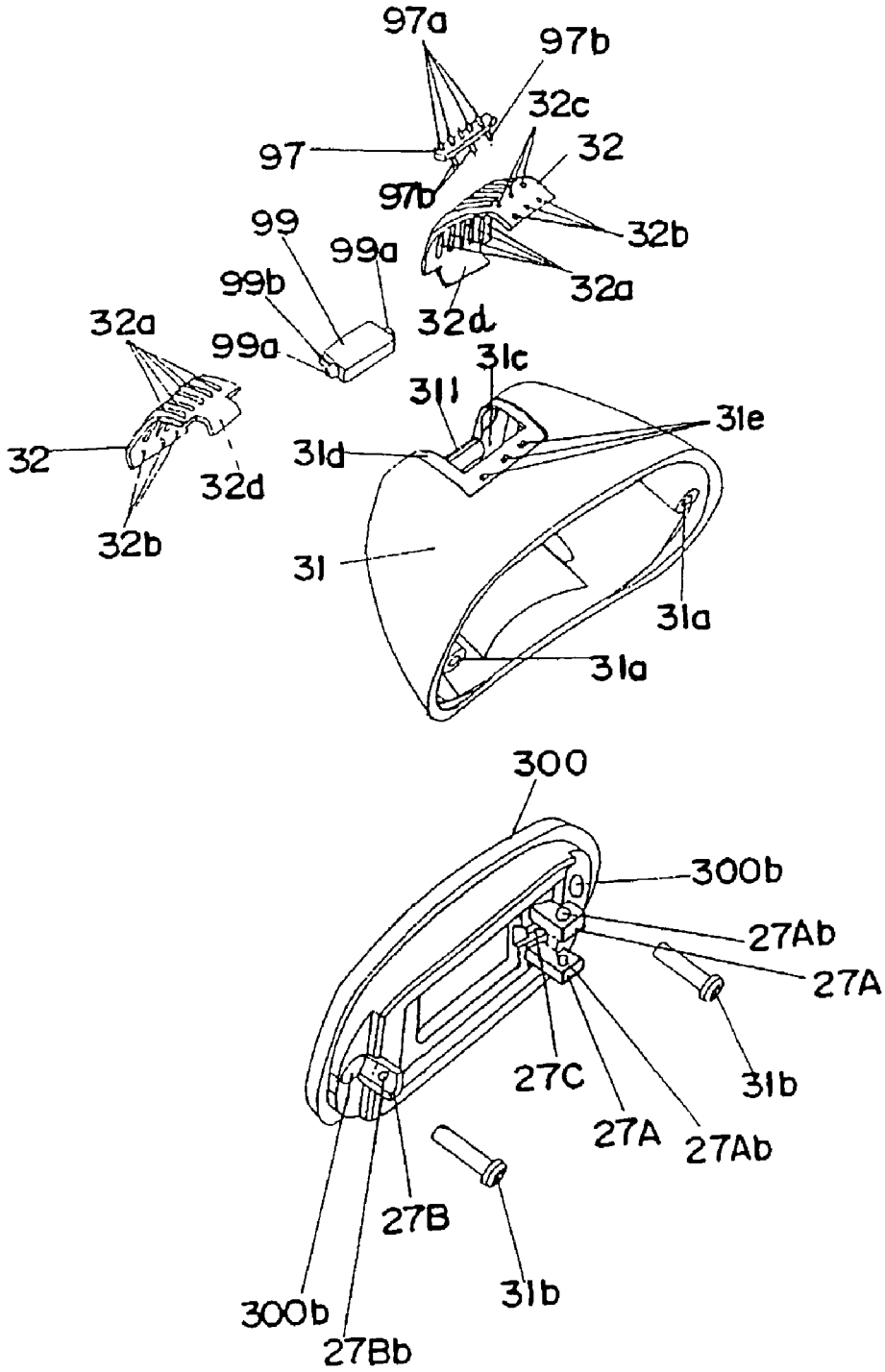
FIG. 11 is another disassembled perspective view of the depilation block according to the embodiment of the invention.
Figure 12:
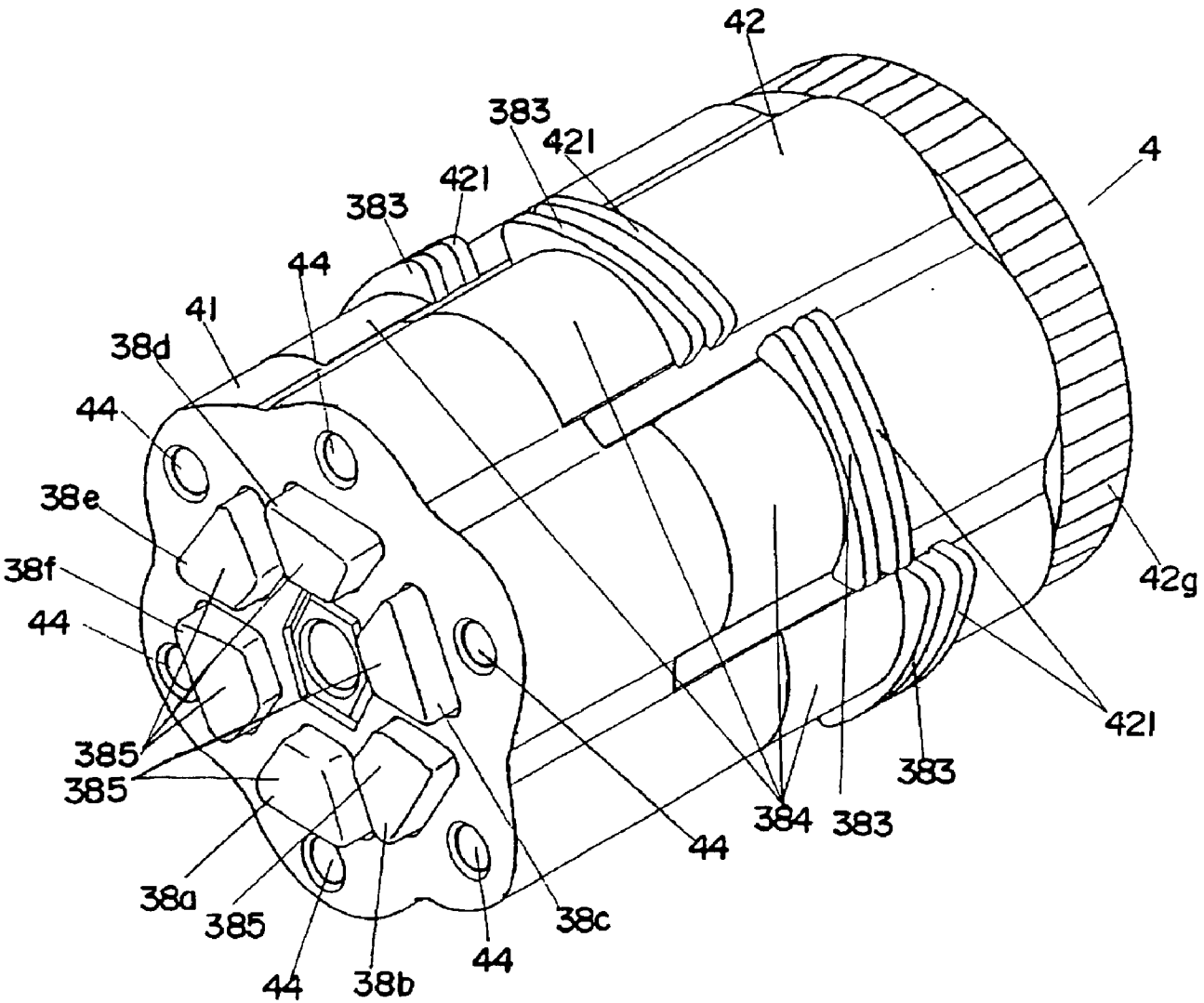
FIG. 12 is a perspective view of a rotating cylinder according to the embodiment of the invention.

Referring to FIGS. 9–11, the depilation head 2 includes a base block 15 and a depilation block 24. The depilation block 24 includes the rotating cylinder 4 equipped with a depilation section, a cylinder mount 27 which supports the rotating cylinder 4, a cylinder cover 28, cams 29, 29, maintenance springs 301, 302, a head frame 31, a base 300, and a plate 32.

The cylinder mount 27 and the cylinder cover 28 attached to one end of the cylinder mount 27 have support sections (27*a*, 28*a*) respectively projecting from their upper parts upwardly. The both ends of a shaft (4*b*) inserted in the rotating cylinder 4 are supported by holes (27*b*, 28*b*) provided in the support sections (27*a*, 28*a*) such that the rotating cylinder 4 freely rotates with respect to the shaft (4*b*). In this embodiment, two rotating cylinders 4 are supported side by side in parallel to each other.

The support sections (27*a*, 28*a*) have cam insertion holes (27*c*, 28*c*) and axial support slots (27*d*, 28*d*) located in the vertical edges of the cam insertion holes (27*c*, 28*c*). Roller type cams 29 are inserted in the cam insertion holes (27*c*, 28*c*). Both vertical ends of roller shafts (29*a*, 29*a*) inserted in the respective cams 29, 29 are inserted in the axial support slots (27*d*, 28*d*). The cams 29, 29 are supported such that they rotate freely in a horizontal plane and such that the cams 29, 29 project partly toward inside from the cam insertion holes (27*c*, 28*c*).

Also, the maintenance springs 301, 302 are attached outside of the support sections (27*a*, 28*a*). The maintenance springs 301, 302 are fixed to the cylinder mount 27 and cylinder cover 28 with screws (301*n*, 302*n*) inserted in holes (301*a*, 302*a*) respectively provided in the maintenance springs 301, 302. Upper parts of the maintenance springs 301, 302 have holes (301*b*, 302*b*), respectively. Both vertical ends of the roller shaft (29*a*) are elastically held by the edges of upper and lower sides of the holes (301*b*, 302*b*), and the holes (301*b*, 302*b*) are formed sufficiently large such that the cams 29 themselves do not touch the maintenance springs 301, 302.

Figure 13:
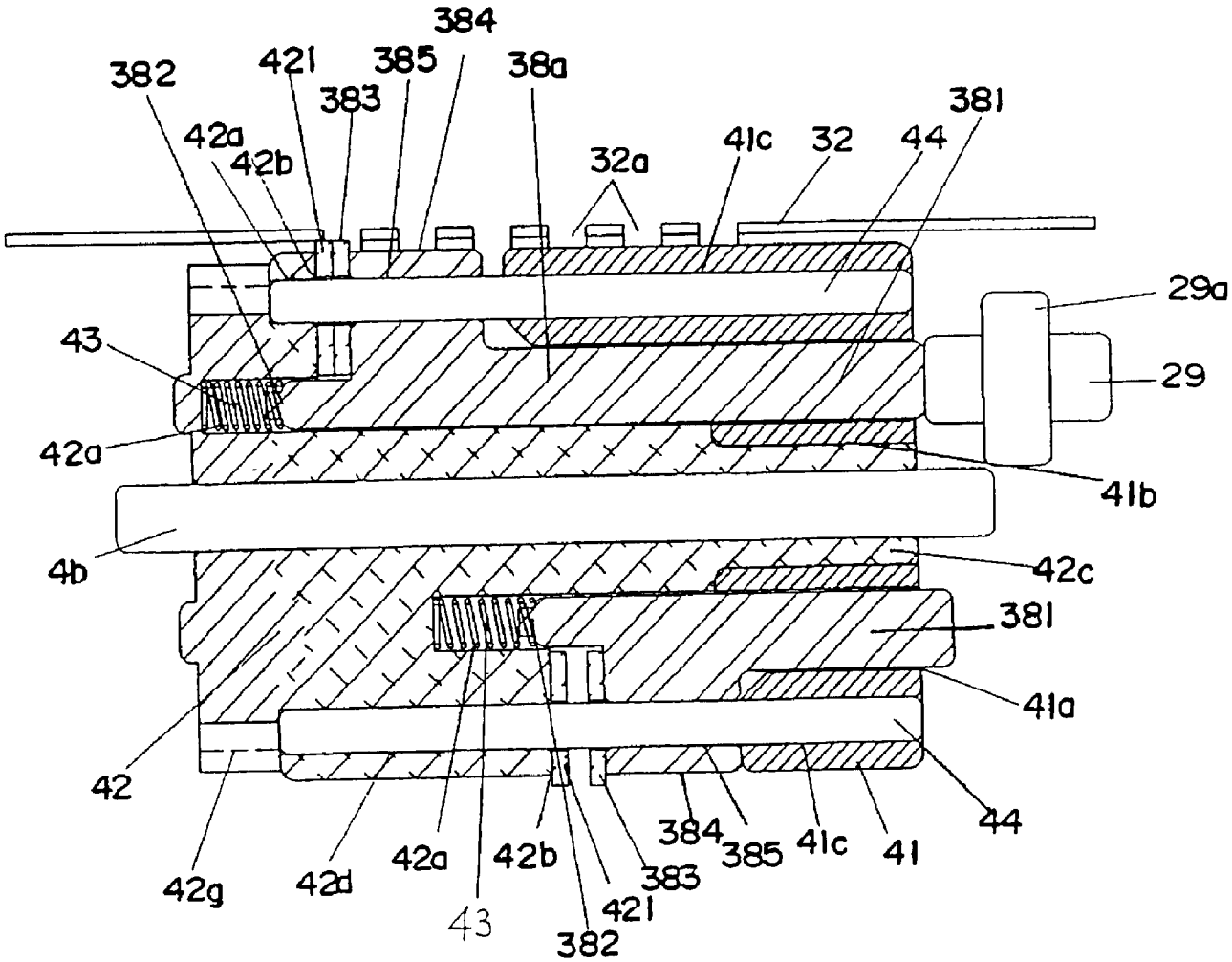
FIG. 13 is a cross-sectional view of the rotating cylinder according to the embodiment of the invention.
Figure 14:
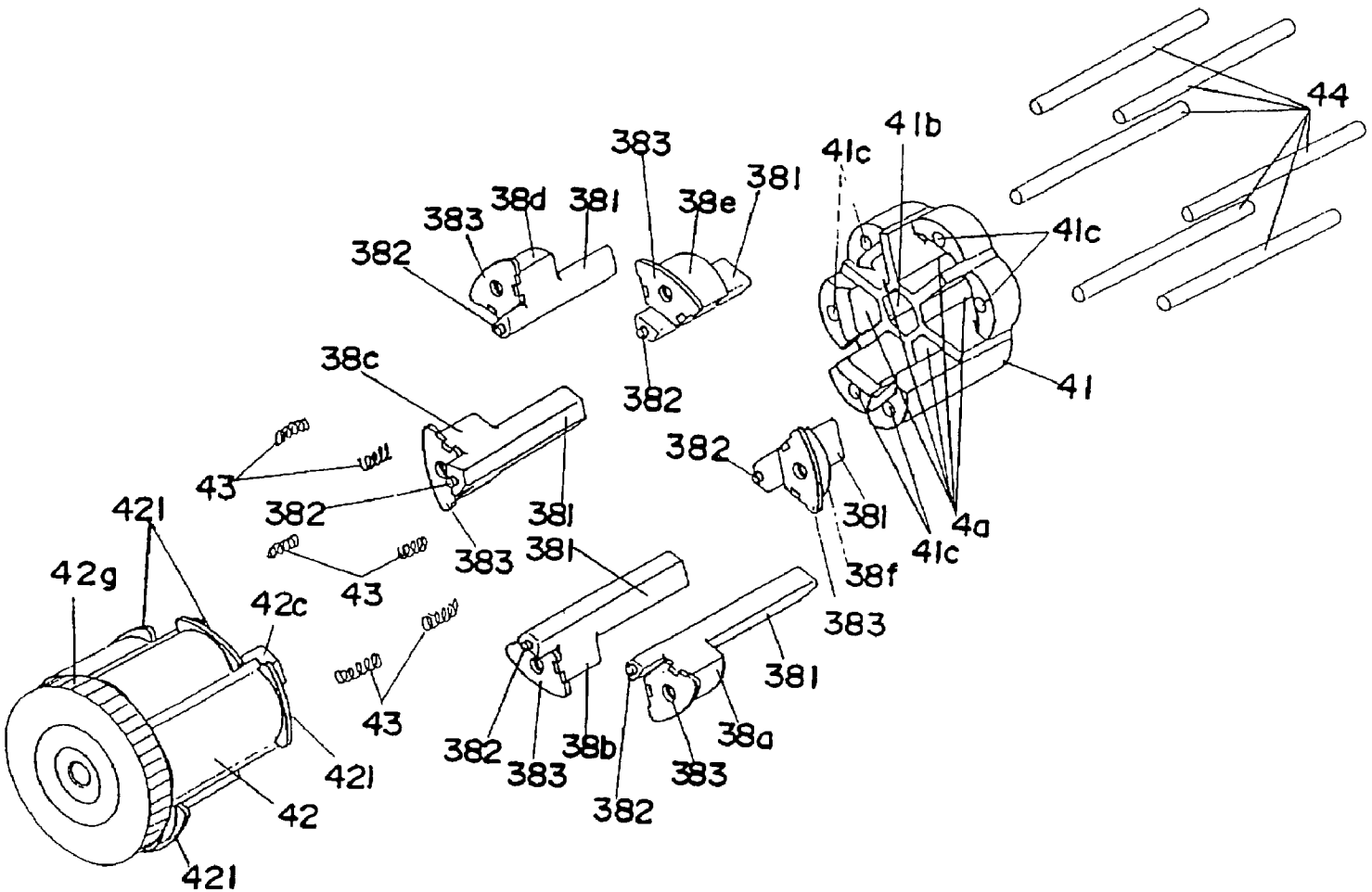
FIG. 14 is a disassembled perspective view of the rotating cylinder according to the embodiment of the invention.
Figure 15:
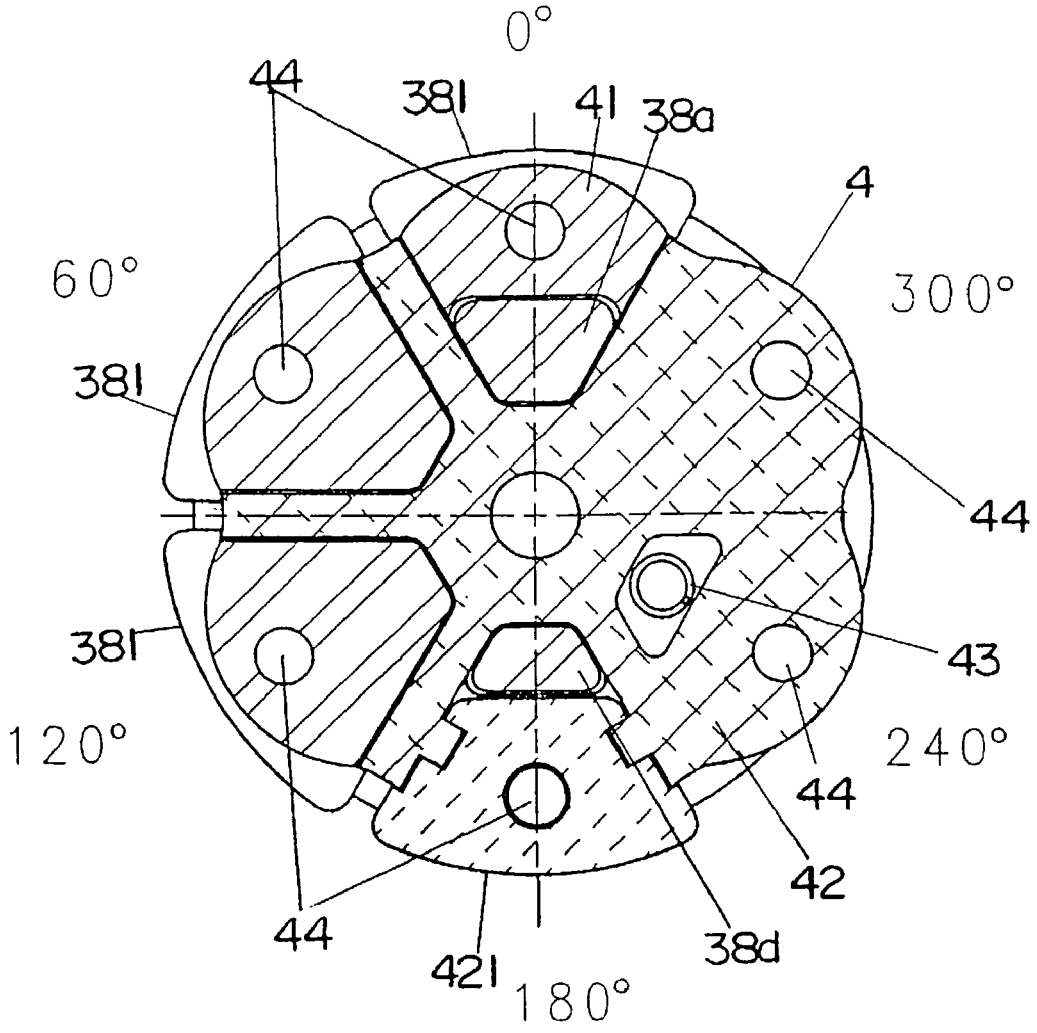
FIG. 15 is a longitudinal section view of a rotating cylinder according to the embodiment of the invention.

Referring to FIGS. 12 to 16, especially as shown in FIG. 14, the rotating cylinder 4 is formed by joining a pair of cylindrical body components (41, 42) in the axial direction. A plurality of concavities (4*a*) are formed in the rotating cylinder 4. The rotating cylinder 4 in FIG. 14 has six concavities (4*a*) at intervals of 60 degrees. Opening-and-closing rods (38*a*, 38*b*, 38*c*, 38*d*, 39*e*, 38*f*) are respectively inserted in the concavities (4*a*). Also, a gear (42*g*) is integrally formed at a side end of one cylindrical body component 42. A plurality of holes (41*a*) are provided on the side surface of the other cylindrical body component 42. Lever sections 381 of the opening-and-closing rods (38*a*, 38*b*, 38*c*, 38*d*, 39*e*, 38*f*) are respectively inserted into a plurality of holes (41*a*) from a center side of the rotating cylinder 4.

The opening-and-closing rods (38*a*, 38*b*, 38*c*, 38*d*, 38*e*, 38*f*) respectively include cylindrical projections 382 at sides thereof opposite to the sides where the lever sections 381 are provided, and the projections 382 engage with return springs 43. Concavities (42*a*) of the concavities (4*a*) are provided in the circumferential direction of the cylindrical body component 42 in the vicinity of the rotational shaft. The opening-and-closing rods (38*a*, 38*b*, 38*c*, 38*d*, 38*e*, 38*f*) engaging with the return springs 43 are inserted into the concavities 42*a*. At this time, When the opening-and-closing rods (38*a*, 38*b*, 38*c*, 38*d*, 38*e*, 38*f*) move toward the cylindrical body component 42, the opening-and-closing rods (38*a*, 38*b*, 38*c*, 38*d*, 38*e*, 38*f*) are elastically urged toward the other cylindrical body component 42 by the reaction force of the return springs 43.

Also, claws 421 for pinching hairs are integrally formed at wall surfaces 42*b* of the cylindrical body component 42 located near the cylindrical body component 41. Claws 383 for pinching hairs by cooperating with the claws 421 are integrally formed at end surfaces of the opening-and-closing rods (38*a*, 38*b*, 38*c*, 38*d*, 38*e*, 38*f*) located near the cylindrical body component 42. Incidentally, the claws 421, 383 may be formed separately from the cylindrical body components 41, 42, respectively.

A hexagon protruding section (42*c*) is formed at the central section of the rotation of the cylindrical body component 42. The protruding section (42*c*) is inserted into a hexagon hole (41*b*) formed at the center of the body component 41, and a plurality of stopper pins 44 are pressed into round holes (41*c*, 42*d*), so that the cylindrical body components 41, 42 are connected to each other. The opening-and-closing rods (38*a*, 38*b*, 38*c*, 38*d*, 38*e*, 38*f*) respectively include portions 384 having the same external shapes as those of the body components 41, 42, and holes 385 are formed at the portions 384. The stopper pins 44 can be used as slide guides for the opening-and-closing rods (38*a*, 38*b*, 38*c*, 38*d*, 38*e*, 38*f*) by inserting the pins 44 into holes 385 formed at the portions 385.

Figure 16:
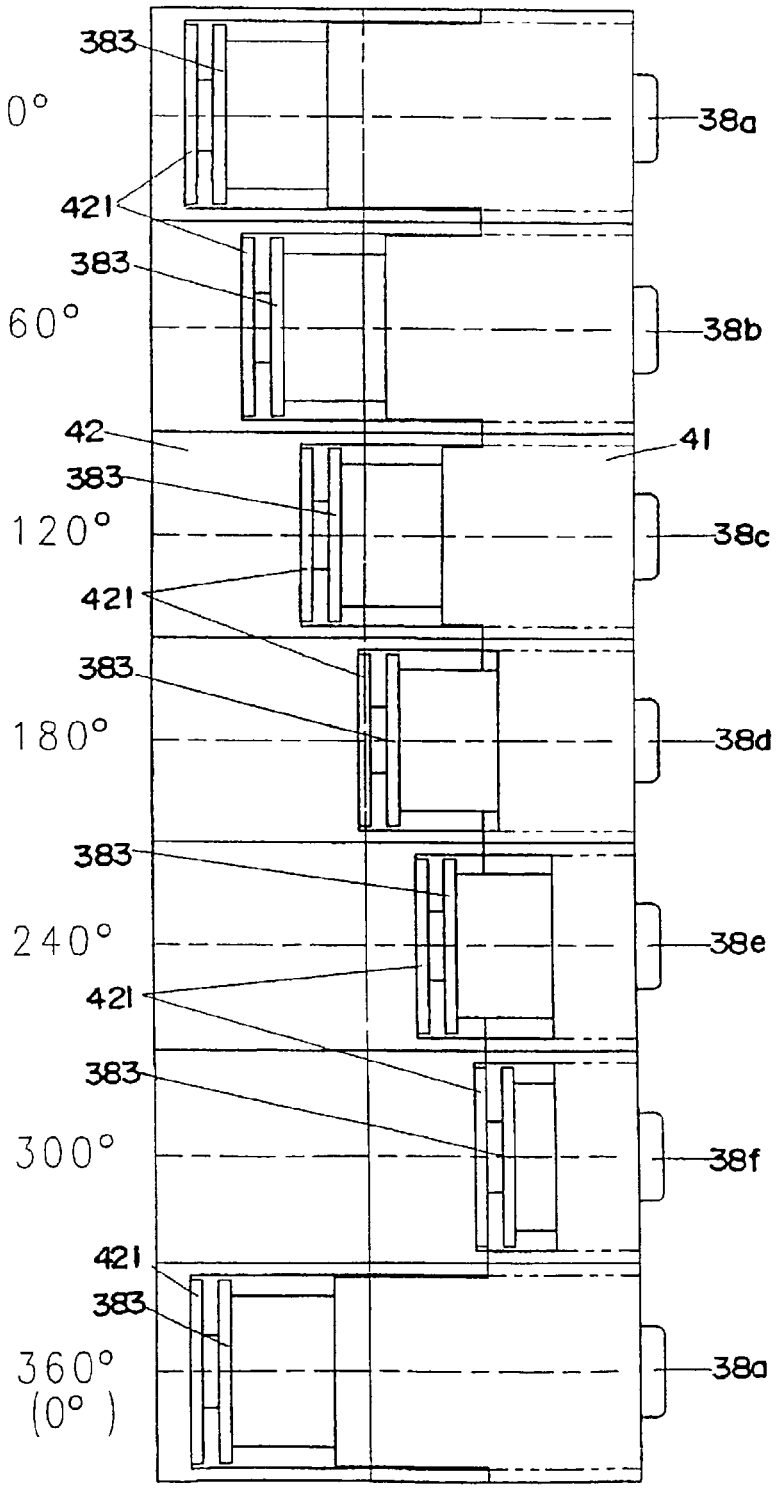
FIG. 16 is a surface development view of a rotating cylinder according to the embodiment of the invention.

The concavities 4*a* arranged in the peripheral direction of the rotating cylinder 4 are shifted in the direction of the rotational shaft at the equal intervals. When the rotating cylinder 4 is shown in a development view as shown in FIG. 16, the positions of grasping hairs by the claws 383, 421 are shifted in the direction of the rotational shaft at the equal intervals. Therefore, it is easy to pull out the aimed hairs, and the depilating device rarely miss pulling the hairs. Thus, the depilation efficiency results in high.

Referring to FIG. 10, the cylinder mount 27 which supports the cylinder 4 through the shaft 4*b* and the cylinder cover 28 further include a plurality of drive transmission gears (20W, 20W, 21W, 22W). The drive transmission gear (22W) is supported by a shaft (22*j*), and is partly exposed to a lower surface of the base 300. The drive transmission gear (22W) meshes with the idle gear (21W) supported by a shaft (21*j*). The gears (20W, 20W) respectively mesh with the idle gear (21W), and also mesh with the gears (42*g*, 42*g*) provided at the end portions of the respective rotating cylinders 4, 4. The rotation of the gear (22W) is transmitted to the respective rotating cylinders 4, 4 through the idle gear (21W) and the gears (20W, 20W), and both the rotating cylinders 4, 4 rotate in the same direction.

Two rotating cylinders 4, 4 have the same configuration in the embodiment. By arranging the rotating cylinders 4, 4 such that the orientations in the shaft directions of the rotating cylinders 4, 4 are opposite to each other, the hair grasping positions (positions of the claws 383, 421) in the rotating cylinders 4, 4 are not overlapped in the shaft direction, and positioned at the equal intervals in the shaft direction. Accordingly, the depilating device do not miss pulling the hairs much further.

Figure 4:
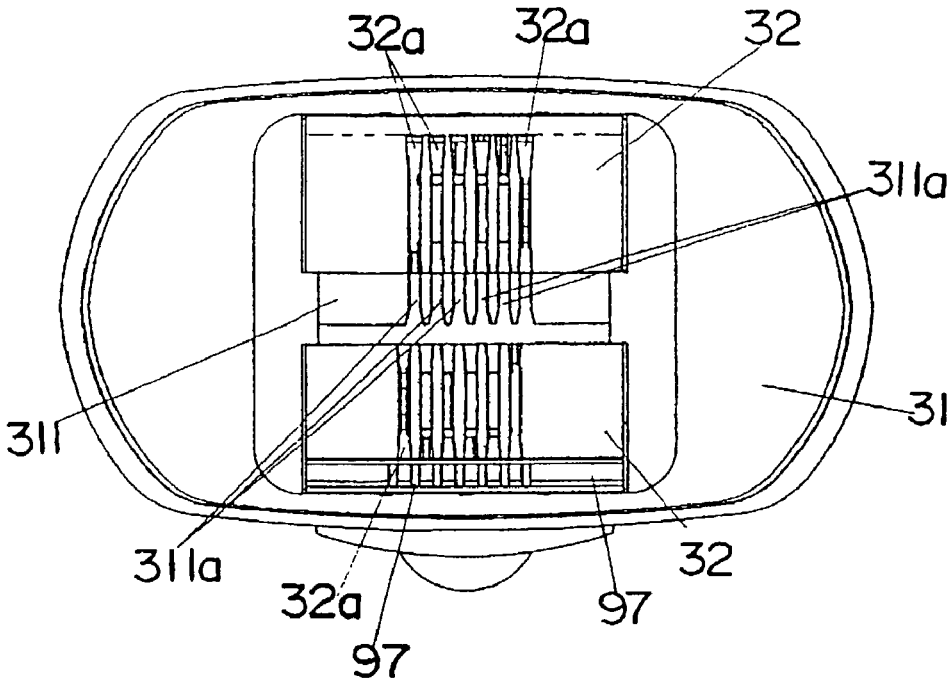
FIG. 4 is a plan view of the depilating device according to the embodiment of the invention.
Figure 5:
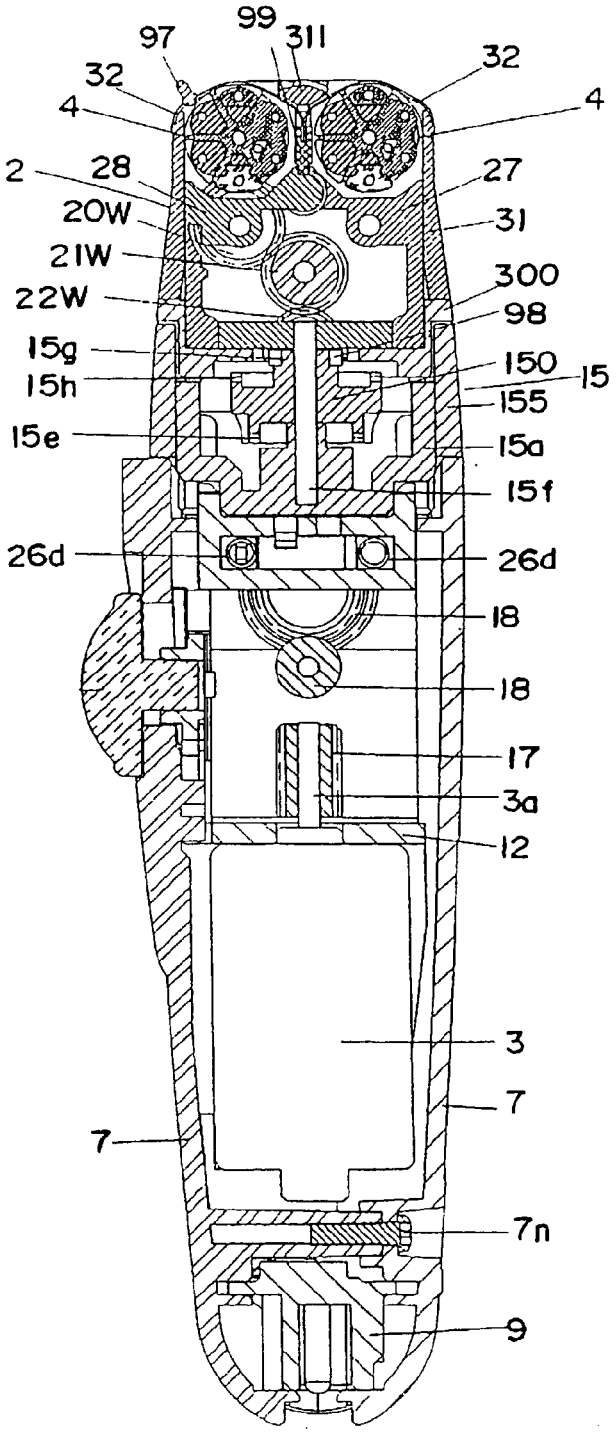
FIG. 5 is a longitudinal section view of the depilating device according to the embodiment of the invention.
Figure 6:
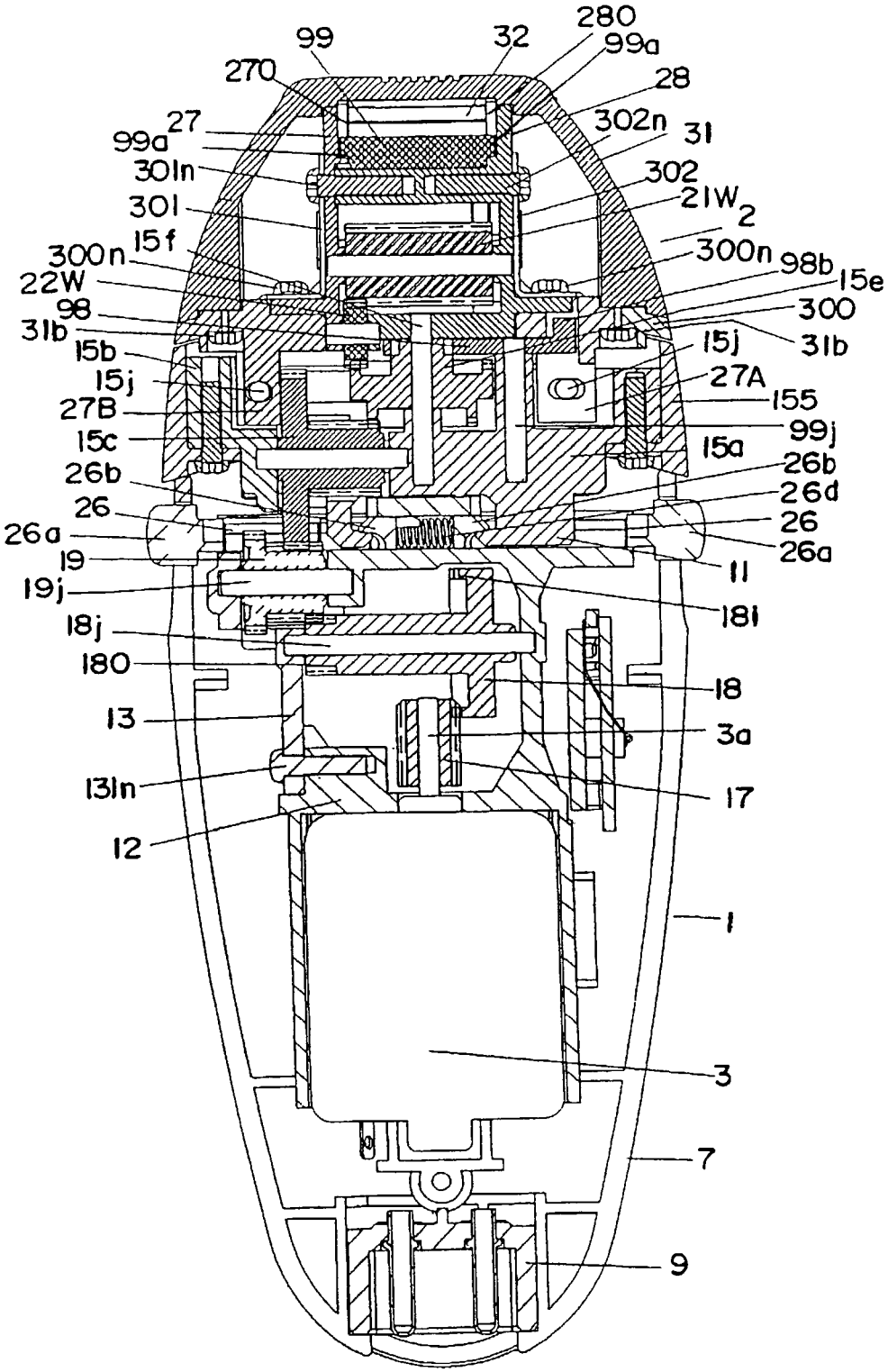
FIG. 6 is a cross-sectional view of the depilating device according to the embodiment of the invention.

Referring to FIG. 11, the head frame 31 includes an opening (31*c*) in which upper sections of the rotating cylinders 4, 4 are exposed. The opening (31*c*) includes a bridge 311 positioned between the rotating cylinders 4, 4. As shown in FIG. 4, an outer surface side (side making contact with the skin) of the bridge 311 includes grooves (311*a*) extending in the direction substantially perpendicular to an axial direction of the rotational shaft, and each width of the groove (311*a*) in the moving direction (toward the lower side in FIG. 4) of the depilating device is formed to be wide. Also, a concave portion (31*d*) having a surface lowered for one step from the outer surface of the head frame 31 is formed at a rim portion of the opening (31*c*) of the head frame 31. The concave portion (31*d*) extends in the front and rear direction and is provided with round projections (31*e*).

Also, a plate holding member 99 is provided below the bridge 311. The plate holding member 99 is thin, and has an elongate shape. The plate holding member 99 includes projections (99*a*) at both ends thereof in the longitudinal direction, and includes narrow grooves (99*b*) at an upper surface of the plate holding member 99.

The plate 32 includes a curved surface which is substantially the same as an external shape of the rotating cylinder 4, and has the arch-shaped section. The curved section of the plate 32 includes a plurality of slits (32*a*) which are elongate in the rotating direction of the rotating cylinder 4. Also, the slits (32*a*) are provided at the outer surface side to face the hair grasping position of the claws (383, 421) of the rotating cylinder 4 such that the claws (381, 421) can be seen through the slits (32*a*). Also, round holes (32*b*) are formed at one end of the plate 32, and holes (32*c*) are provided above the round holes (32*b*) and near the ends of the slits (32*a*). The other end of the plate 32 includes projecting portion (32*d*).

Under the state that two plates 32, 32 corresponding to two rotating cylinders 4, 4 are arranged with respect to the bridge 311 of the head frame 31 such that the projecting portions (32*d*, 32*d*) at the ends of the plates 32, 32 face each other, the projecting portions (32*d*, 32*d*) are inserted under the bridge 311, and the round projections 31*e* are fitted to the round holes (32*b*) of the other ends of the plates 32, 32, so that the plates 32, 32 are positioned and fixed to the head frame 31. At the time, the peripheral rim portions of the plates 32, 32 are positioned at the concave portion (31*d*), so that the plates 32 are prevented from moving.

The holes (32*c*) provided near the ends of the slits (32*a*) of the plate 32 are fitted with a comb 97. The comb 97 includes comb-like projections (97*a*) on the front surface side thereof, and is formed of an elastic member. Projections (97*b*) for attachment formed at a rear surface of the comb 97 are inserted into the holes (32*c*), and the projections (97*b*) for attachment are deformed from the rear side of the plate 32, so that the comb 97 is fixed to the plate 32.

When a pair of plates 32, 32 are attached to the head frame 31 as described above, the projecting portions (32*d*, 32*d*) of the plates 32, 32 are overlapped with each other. At this portion, the plate holding member 99 is inserted from the lower side of the head frame 31, and the overlapped projecting portions (32*d*, 32*d*) of the plates 32 are clamped by the narrow grooves (99*b*) and fixed.

The screws (31*b*, 31*b*) are inserted into holes (300*b*, 300*b*) formed at right and left sides of the base 300, and bolted in screw bosses (31*a*, 31*a*) formed at right and left inner sides of the lower portion of the head frame 31, so that the base 300 is fixed to the head frame 31. At this time, the projections (99*a*) at both ends of the plate holding member 99 in the longitudinal direction are positioned along grooves 270, 280 for attaching the plate holding member. The grooves 270, 280 for attaching the plate holding member are respectively provided in the cylinder mount 27 and the cylinder cover 28.

If springs are attached below the projections (99*a*) at both ends of the plate holding member 99, the plate holding member 99 can be elastically urged along the grooves 270, 280 provided upwardly in the cylinder mount 27 and the cylinder cover 28.

As shown in FIG. 9, the base block 15 includes a base body (15*a*) equipped with hooks (11, 11) at a lower surface thereof, a base cover (15*b*) connected to a side surface of the base body (15*a*) by screws (15*n*, 15*n*), a base block cover (155) for accommodating these components, gears (15*c*, 150) attached to the base body (15*a*) and the base cover (15*b*), and a link pin 98. Both ends of a shaft (105*j*) are supported by the base body (15*a*) and the base cover (15*b*), which are connected to each other by the screws (15*n*, 15*n*). The gear (15*c*) held by the shaft (105*j*) includes a pinion (15*d*) integrally provided therewith. The gear 150 is attached by the shaft (15*f*) such that the gear 150 freely rotates in a horizontal plane. The gear 150 includes an eccentric cam (15*g*), a face gear (15*e*) facing downwardly and a face gear (15*h*) facing upwardly. The face gear (15*e*) meshes with the pinion (15*d*).

The link pin 98 in an elongate fan shape includes an elongated hole (98*a*) at one end side thereof having a wide width, and a swinging pin (98*b*) at the other end side. A pin (99*j*) substantially parallel to the shaft (15*f*) is inserted into a hole (98*c*) formed at a middle portion of the link pin 98, such that the link pin 98 is freely rotatable around the pin (99*j*). Then, the eccentric cam (15*g*) of the gear 150 is located inside the hole (98*a*), and the link pin 98 swings around the pin (99*j*) with the rotation of the eccentric cam (15*g*).

The depilation block 24 is attached to the upper surface side of the base block 15 assembled by fixing the base block cover 155 to the base body (15*a*) and the base cover (15*b*) by the screws (155*n*). In other words, ribs (27A, 27A, 27B) projecting in the lower surface of the base 300 of the depilation block 24 are inserted into the concavities of the base block 15, and at the same time, the upper end of the shaft (15*f*) projecting from the upper surface of the base block 15 is inserted into the hole (27*f*) at the lower surface of the cylinder cover 28, so that the face gear (15*h*) meshes with the gear (22W). Further, the swinging pin (98*b*) of the link pin 98 is engaged with an elongated hole (27C) formed in the base 300, and the shafts (15*j*, 15*j*) having both ends supported by the base body (15*a*) and the base cover (15*b*) are idly inserted into holes (27Ab, 27Ab, 27Bb) formed in the ribs (27A, 27A, 27Bb). Accordingly, the depilation block 24 is connected to the base block 15, and the depilation block 24 is freely rotatable within a range of a small angle around the shaft (15*f*). While allowing the rotation of the depilation block 24 around the shaft (15*f*), the depilation block 24 can be easily assembled with the base block 15 by inserting the shafts (15*j*).

In the depilation head 2 including the depilation block 24 and the base block 15, a pair of the hooks 11, 11 projecting from the lower surface of the depilation head 2 are inserted into the rectangular openings of the slide frames 26, 26, under the condition that the controlling elements (26*a*, 26*a*) of the housing 1 are pushed, and then pushing the controlling elements (26*a*, 26*a*) is released, so that the slide frames 26 are moved toward the outside, that is, away from each other, due to the spring forces of the springs (26*d*, 26*d*). Accordingly, the support hooks (261*b*, 261*b*) are hooked on the hooks 11, 11, so that the depilation head 2 is attached to the housing 1. At this time, since the gear 19 in the housing 1 meshes with the gear (15*c*), the rotation of the motor 3 is transmitted to the rotating cylinders 4. In order to detach the depilation head 2 from the housing 1, by pushing the controlling elements (26*a*, 26*a*), the support hooks (261*b*, 261*b*) are disengaged from the hooks 11, 11, so that the depilation head 2 can be released from the housing 1.

In the depilating device structured as described above, if the motor 3 is driven under the condition that the depilation head 2 is attached to the housing 1, the rotation of the motor 3 is transmitted to the gear (15*c*) through the gear 18 and the gear 19. Then, the rotation of the gear (15*c*) is transmitted to the gear (42*g*) provided in the rotating cylinder 4 through the gears (22W, 21W, 20W), so that the rotating cylinder 4 rotates.

When the rotating cylinder 4 rotates, the opening-and-closing rods (38*a*, 38*b*, 38*c*, 38*d*, 38*e*, 38*f*) are moved to the position of the cam 29 as shown in FIG. 13. Then, one of the opening-and-closing rods (38*a*, 38*b*, 38*c*, 38*d*, 38*e*, 38*f*) is pushed by the cam 29 toward inside resisting the return spring 43. The claw 383 of one of the opening-and-closing rods (38*a*, 38*b*, 38*c*, 38*d*, 38*e*, 38*f*) contacts the claw 421. Hence, hairs are pinched between the claws 383, 421, if there are any hairs therebetween. Then, as the rotating cylinder 4 rotates, if the hairs are pinched between the claws 383, 421, the hairs are pulled out. When the rotating cylinder 4 rotates further, another opening-and-closing rod (38*a*, 38*b*, 38*c*, 38*d*, 38*e*, or 38*f*) moves into the position of the cam 29, and is pushed by the cam 29. Accordingly, hairs are pinched by the claw 383 of the opening-and-closing rod (38*a*, 38*b*, 38*c*, 38*d*, 38*e*, or 38*f*) and the claw 421, and pulled out due to the rotation of the rotating cylinder 4. When the pressing force by the cam 29 applied to the opening-and-closing rods (38*a*, 38*b*, 38*c*, 38*d*, 38*e*, 38*f*) is released, the opening-and-closing rods (38*a*, 38*b*, 38*c*, 38*d*, 38*e*, 38*f*) return to the predetermined original positions, so that the claws 383 are separated from the claws 421 to be in a standby state for pinching the following hairs.

In the rotating cylinder 4, since operations of opening and closing a space between the claw 421 and the claw 383 are carried out by the opening-and-closing rods (38*a*, 38*b*, 38*c*, 38*d*, 38*e*, 38*f*) which are substantially parallel to the rotational shaft, the hairs can be pinched at the outermost peripheral portion of the rotating cylinder 4. Accordingly, even the short hair can be easily pinched and pulled out by the claws 383, 421.

Also, the plate 32 located on the rotating cylinder 4 prevents the rotating cylinder 4 from making direct contact with the skin. Thus, the safety for the skin at the time of using the depilating device can be improved.

Moreover, the plate 32 is provided with the slits (32*a*) parallel to the rotating direction of the rotating cylinder 4. In other words, the longitudinal direction of each slit (32*a*) agrees with the moving direction of the depilating device when the depilating device is moved along the skin surface to remove hairs, so that the hairs can be easily introduced into the slits (32*a*). Also, since both side rims of each slit (32*a*) press the root of the hair, even the short hair is squeezed out from the skin to have a longer length from the skin surface, so that the short hair can be securely pinched and pulled out by claws 383, 421.

Figure 17:
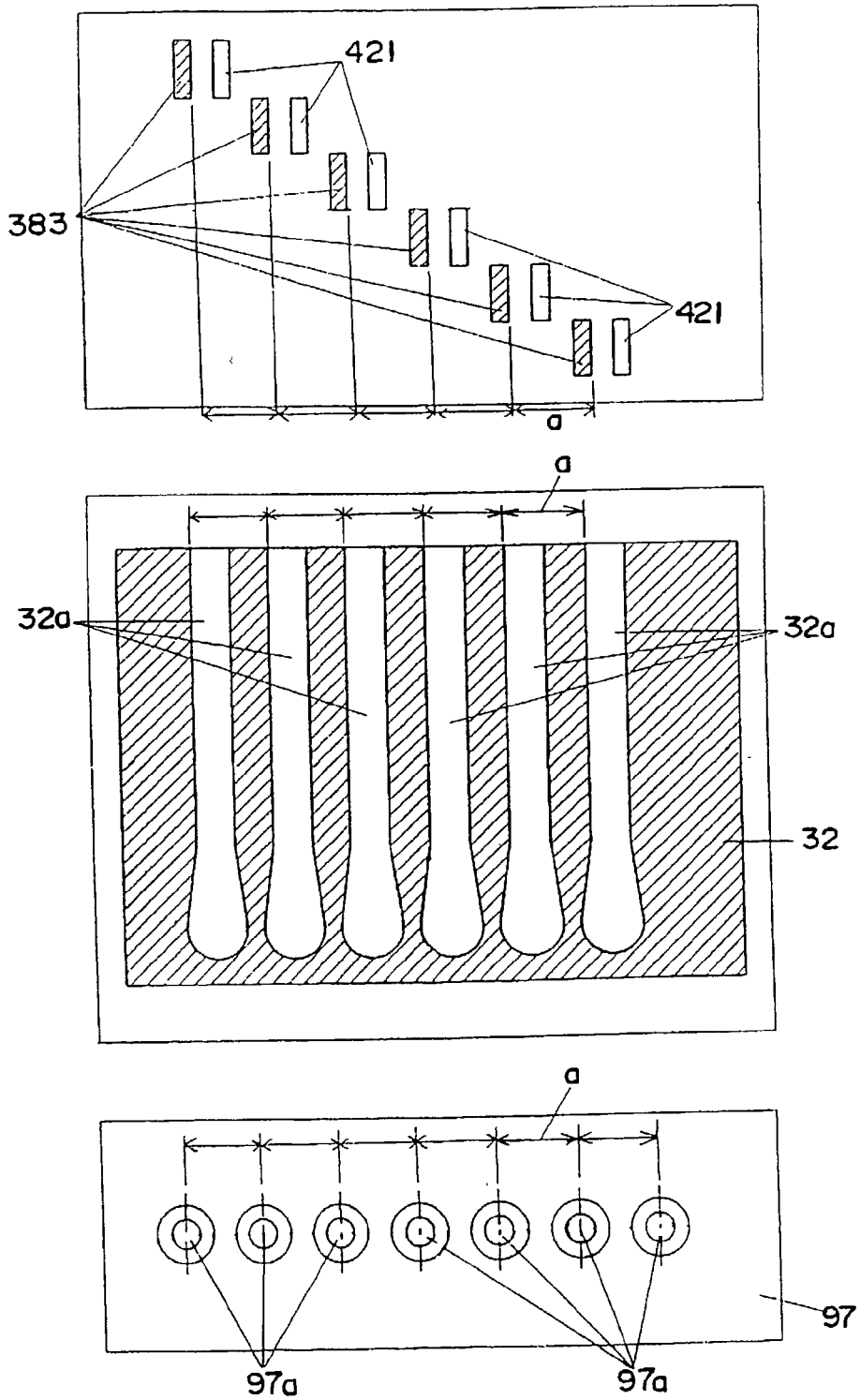
FIG. 17 is a schematic development view of the rotating cylinder, a plate, and a comb according to the embodiment of the invention.

As shown in FIG. 17, an interval (a) between the respective two adjacent rows of the claws 383 and an interval between the respective two adjacent rows of the claws 421 provided in the rotating cylinder 4 are arranged to respectively agree with an interval between the side edges on the same side of the slits (32*a*, 32*a*) provided in the plate 32, that is, a pitch of the slit (32*a*). Further, the intervals between the rows of the claws 383, 421 are positioned to be shifted from the intervals of the edges of the slits (32*a*, 32*a*) in the direction of the rotational shaft. Therefore, the hairs passing through the position of the slit (32*a*) of the plate 32 always pass through the space between the claws 383, 421 in the rotating cylinder 4, and the hairs can be securely introduced between the claws 383, 421.

Also, as shown in FIG. 13, the outer peripheral rims of the claws 383, 421 as hair pinching pieces are slightly projected from the outer peripheral surface of the rotating cylinder 4, such that the claws 383, 421 are much closer to the inner surface of the plate 32. Accordingly, the distance between the skin and the claws 383, 421 can be shortened, so that the depilation efficiency of removing the short hair can be improved.

Further, if the inner surface of the plate 32 is elastically in contact with the outer peripheral rims of the claws 383, 421, the distance between the inner surface of the plate 32 and the claws 383, 421 is always zero, so that the depilation efficiency can be further increased. In this case, if the claws 383, 421 are slightly projected from the outer peripheral surface of the rotating cylinder 4, the outer peripheral surface of the rotating cylinder 4 does not make contact with the inner surface of the plate 32, so that the sliding resistance can be reduced. Therefore, the plate 32 is not heated.

Moreover, since a plurality of claws 383, 421 sequentially make contact with the inner surface of the plate 32 as the rotating cylinder 4 rotates, the plate 32 provides the vibration in the direction which is substantially perpendicular to the rotational shaft of the rotating cylinder 4 and is a direction of being closer to or away from the skin. This vibration can prevent such an incident that the plate 32 clings to the skin to thereby obstruct the movement of the depilating device along the skin.

Also, if the center of the curved surface of the plate 32 coincides with the center of the rotating cylinder 4, a distance of a section where the plate 32 is in contact with the claws 383, 421, or a distance (a distance in the direction of the circumference of the rotating cylinder 4) of a section where the plate 32 is most closely in contact with the claws 383, 421 can be made long. Therefore, the depilation efficiency can be further improved.

Further, if the plate 32 is too thick, the distance between the claws 383, 421 and the skin becomes too long. Thus, it is preferable that the thickness of the plate 32 is as thin as possible. However, considering that the slits (32*a*) are formed in the plate 32 in the rotating direction of the rotating cylinder 4, the strength of the narrow strip formed between the slits (32*a*) should not be too weak. Therefore, it is preferable that the plate 32 is made of the thin material having the strength, in other words, the thin metal plate having the strength.

The width of each slit (32*a*) provided in the plate 32 and the thickness of the plate 32 are set such that the skin reaches the place near the inner surface of the plate 32 but does not project inwardly from the inner surface of the plate 32 even if the skin is squeezed by the slit (32*a*) when the depilating device is pushed against the skin. In this case, if the width of each slit (32*a*) is set to be in a range of twice to five times the thickness of the plate 32, the desirable results can be obtained.

In addition, as shown in FIG. 17, if the end portion of each slit (32*a*) in the forwarding or moving direction is widened, the hair is introduced into the slit (32*a*) at the widened portion thereof Thus, the long hairs can be also introduced between the claws 383, 421 and pulled out.

Figure 18:
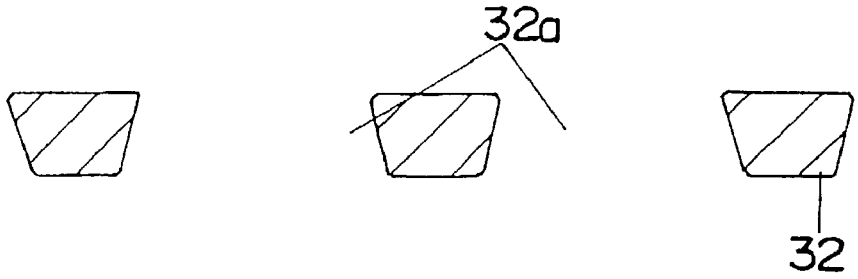
FIG. 18 is an enlarged, partial sectional view of the plate according to the embodiment of the invention.
Figure 19:
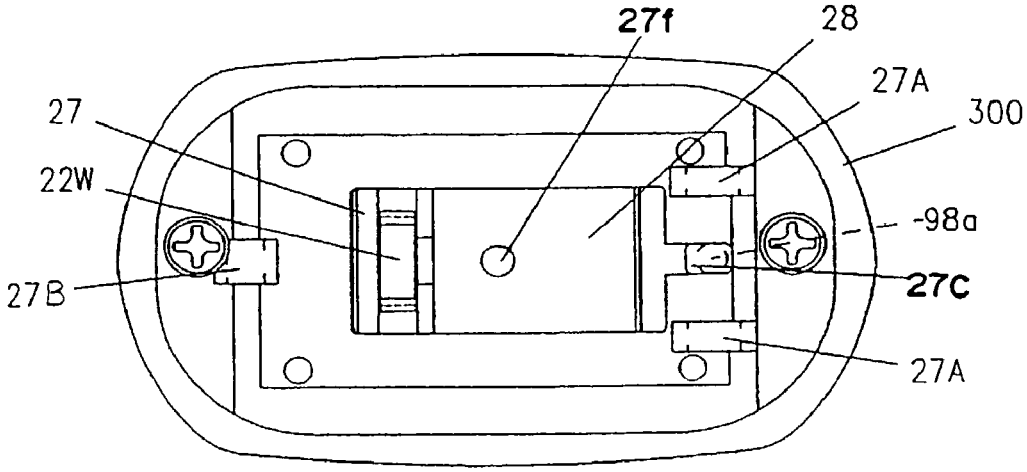
FIG. 19 is a bottom plan view of the depilation block according to the embodiment of the invention.
Figure 20:
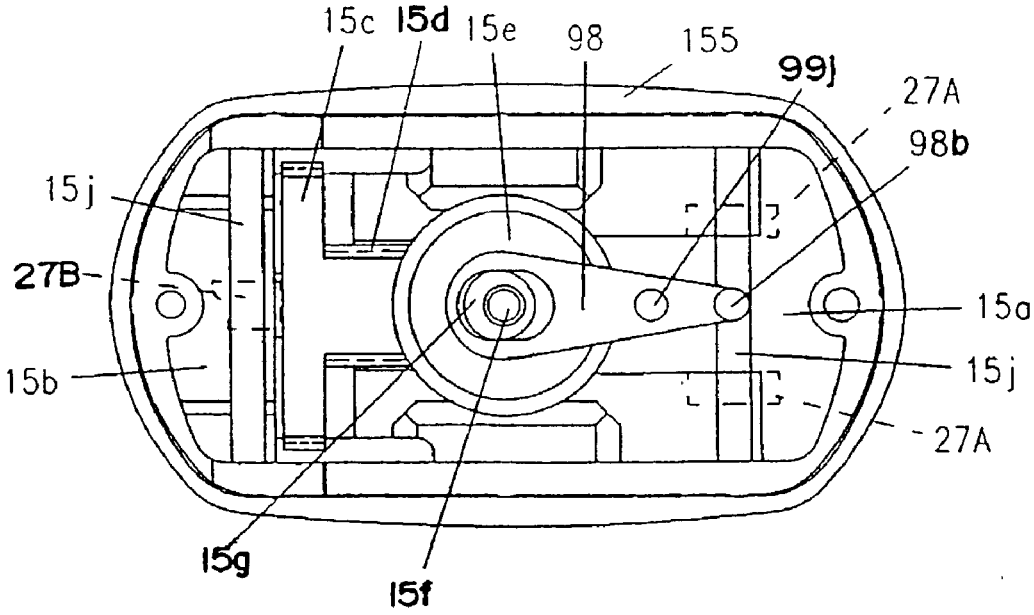
FIG. 20 is a plan view of the base block according to the embodiment of the invention.
Figure 21B:
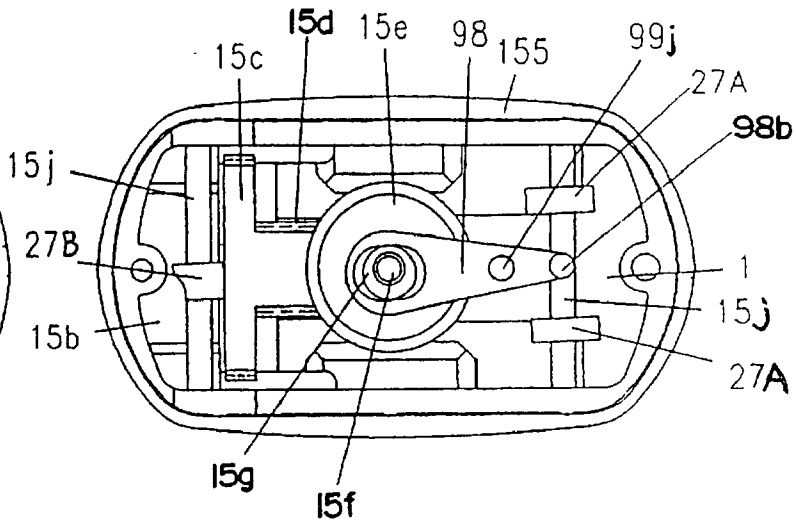
FIGS. 21(*a*) and 21(*b*) show a swinging movement of the depilation block, wherein FIG. 21(*a*) is a plan view of the depilation head according to the embodiment of the invention, and FIG. 21(*b*) is a plan view of the base block according to the embodiment of the invention.
Figure 21A:
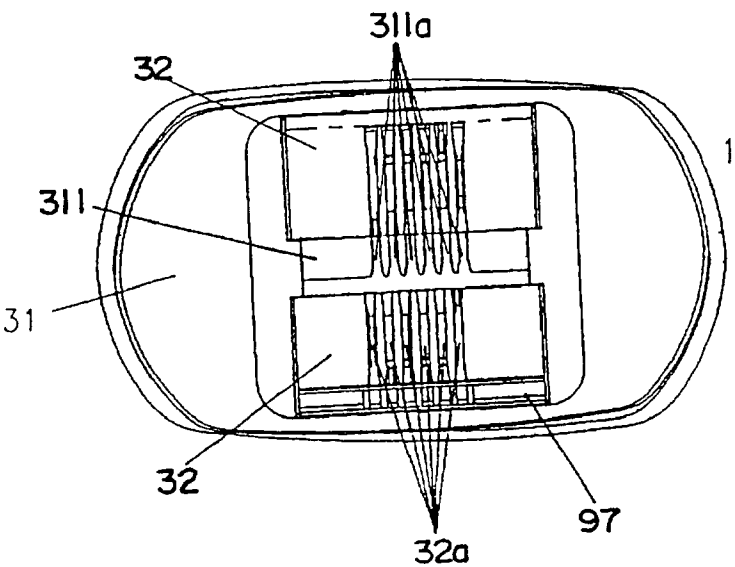
Figure 22B:
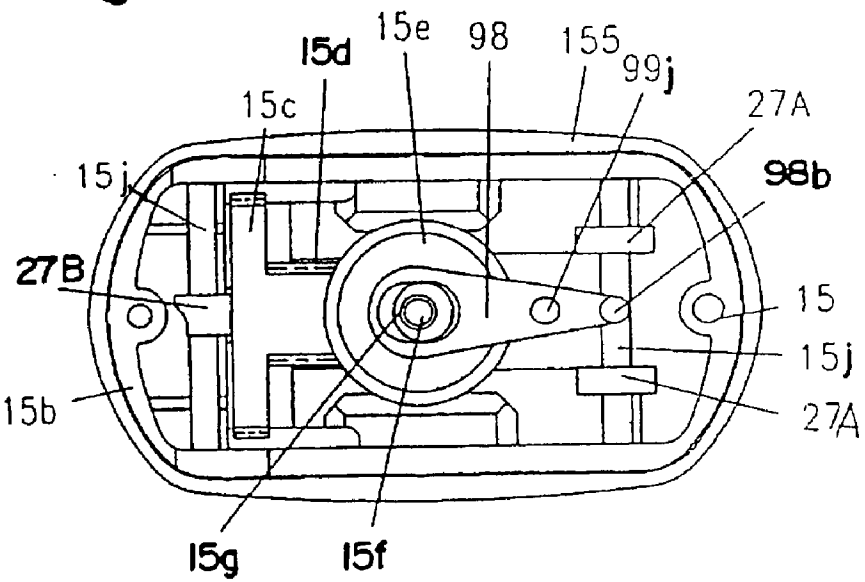
FIGS. 22(*a*) and 22(*b*) show a swinging movement of the depilation block, wherein FIG. 22(*a*) is a plan view of the depilation head according to the embodiment of the invention, and FIG. 22(*b*) is a plan view of the base block according to the embodiment of the invention.
Figure 22A:
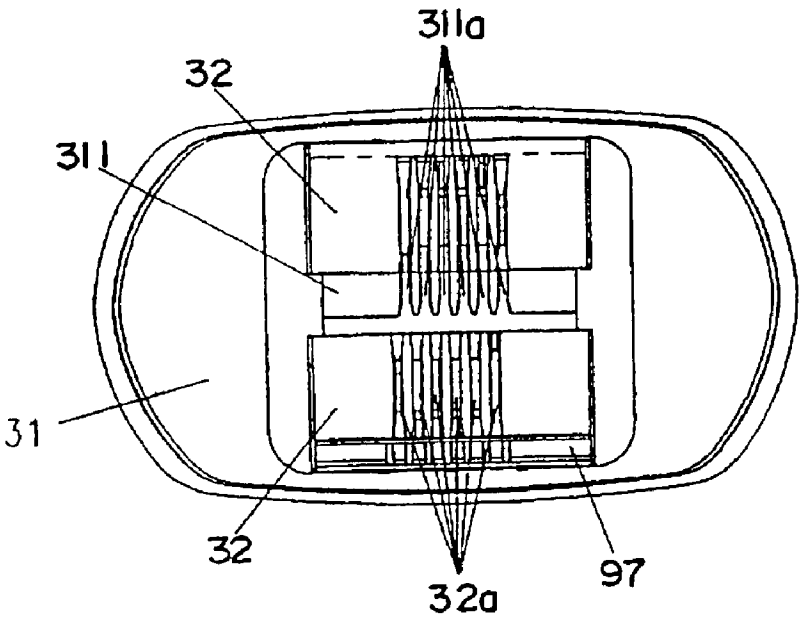
Figure 23B:
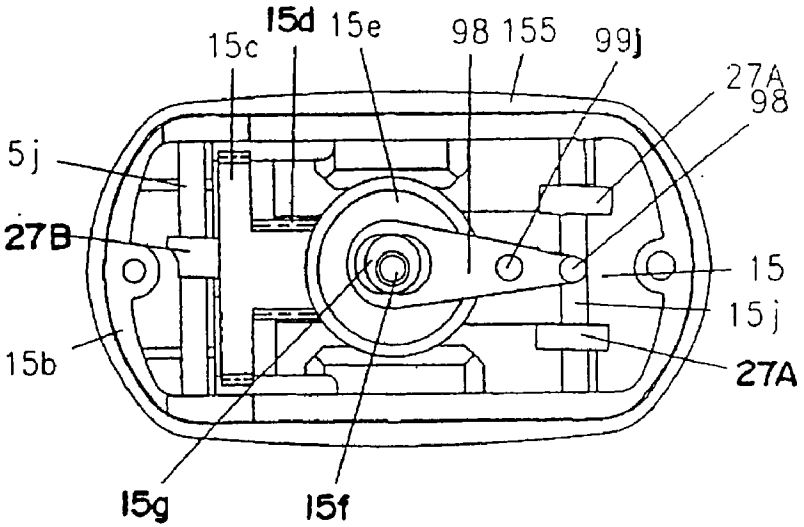
FIGS. 23(*a*) and 23(*b*) show a swinging movement of the depilation block, wherein FIG. 23(*a*) is a plan view of the depilation head according to the embodiment of the invention, and FIG. 23(*b*) is a plan view of the base block according to the embodiment of the invention.
Figure 23A:
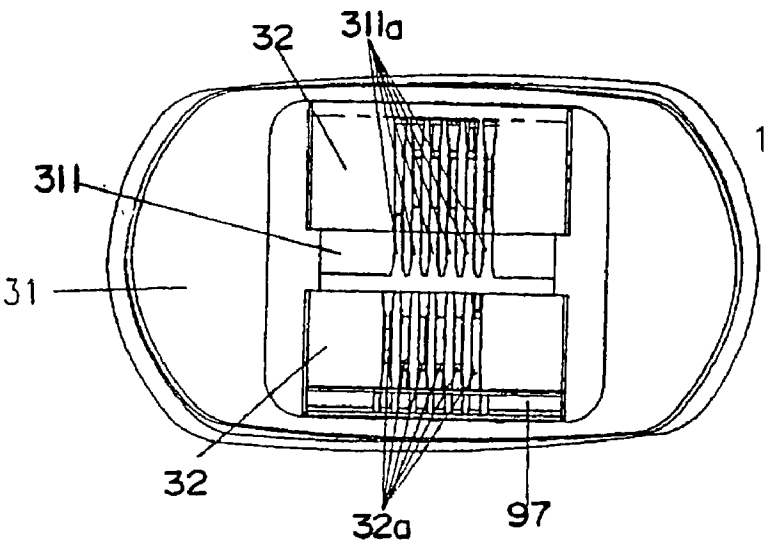

As shown in FIG. 18, a shape of the section of each slit (32*a*) is formed such that the skin surface side, that is, the surface facing the skin surface, is wide and the plate inner surface side, that is, the side facing the inner surface of the plate 32, is narrower. The slit (32*a*) is gradually narrowed from the skin surface side toward the plate inner surface side. Therefore, when the plate 32 is in contact with the skin, the skin can easily enter between the slits (32*a*, 32*a*). Accordingly, the effect of squeezing out the short hair by both side rims of the slit (32*a*) can be improved.

Further, as shown in FIG. 17, there is provided the comb 97 in which the comblike projections (97*a*) are arranged side by side in the direction extending substantially in the direction of the rotational shaft of the rotating cylinder 4. Also, a pitch of the comblike projection (97*a*) is set to substantially agree with the pitch of the slit (32*a*). Further, the comblike projections (97*a*) are positioned on extension lines of the stripes between the slits (32*a*) such that the forward ends of the slits (32*a*) are opened. Accordingly, the hairs combed by the projections (97*a*) of the comb 97 can be more easily introduced into the slits (32*a*) of the plate 32. In addition, a space between the distal end of the comblike projection (97*a*) of the comb and the peak portion of the curved surface of the plate 32 constitutes a concave space extending in the shaft direction of the rotating cylinder 4. Therefore, the long hairs can be raised, and the raised hairs can be introduced into the slits (32*a*) and removed.

Incidentally, if the front surface of the plate 32 is smooth, in case the depilating device is used at the place such as the armpit, the plate 32 may cling to the skin. Thus, it is preferable that the front surface of the plate 32 is slightly uneven. The same effect can be obtained when the plate 32 is vibrated in the substantially vertical direction with respect to the skin.

Also, in the depilating device according to another embodiment of the present invention, when the motor 3 is driven, the rotating cylinder 4 is rotated and the claws 383, 421 as the depilation section are opened and closed. Moreover, by driving the motor 3, a periodic oscillating or swinging movement of the depilation block 24 is carried out by the link pin 98 formed in the base block 15 as shown in FIG. 19 to FIG. 23(*b*).

Namely, when the gear 150 of the base block 15 located in the rotation transmission path extending from the motor 3 to the rotating cylinder 4 is rotated, the link pin 98 performs periodic swinging movement by the eccentric cam (15*g*). In the depilation block 24 which is capable of freely rotating around the shaft (15*f*) of the base block 15, since the swinging pin (98*b*) of the link pin 98 is engaged with the elongated hole (27C) formed in the base 300, the depilation block 24 performs the periodic swinging (ocillating) movement.

Since the depilation block 24 performs the swinging movement described above, even at the soft skin portion, such as the armpit, the skin is reluctant to move together with the depilating device when the depilating device is moved along the skin. Accordingly, the hairs can be introduced more easily, so that the depilation efficiency is further improved. Also, since the swinging movement is the invariable periodic movement, frictional resistance of the skin against the rotating cylinder 4 is made small, resulting in improving the usability of the depilating device. Incidentally, since the face gear (15*g*) rotating around the shaft (15*f*) meshes with the gear (22W), the rotation is transmitted from the base block 15 to the rotating cylinder 4. Thus, the swinging movement does not interfere with the rotation transmission.

Figure 24:
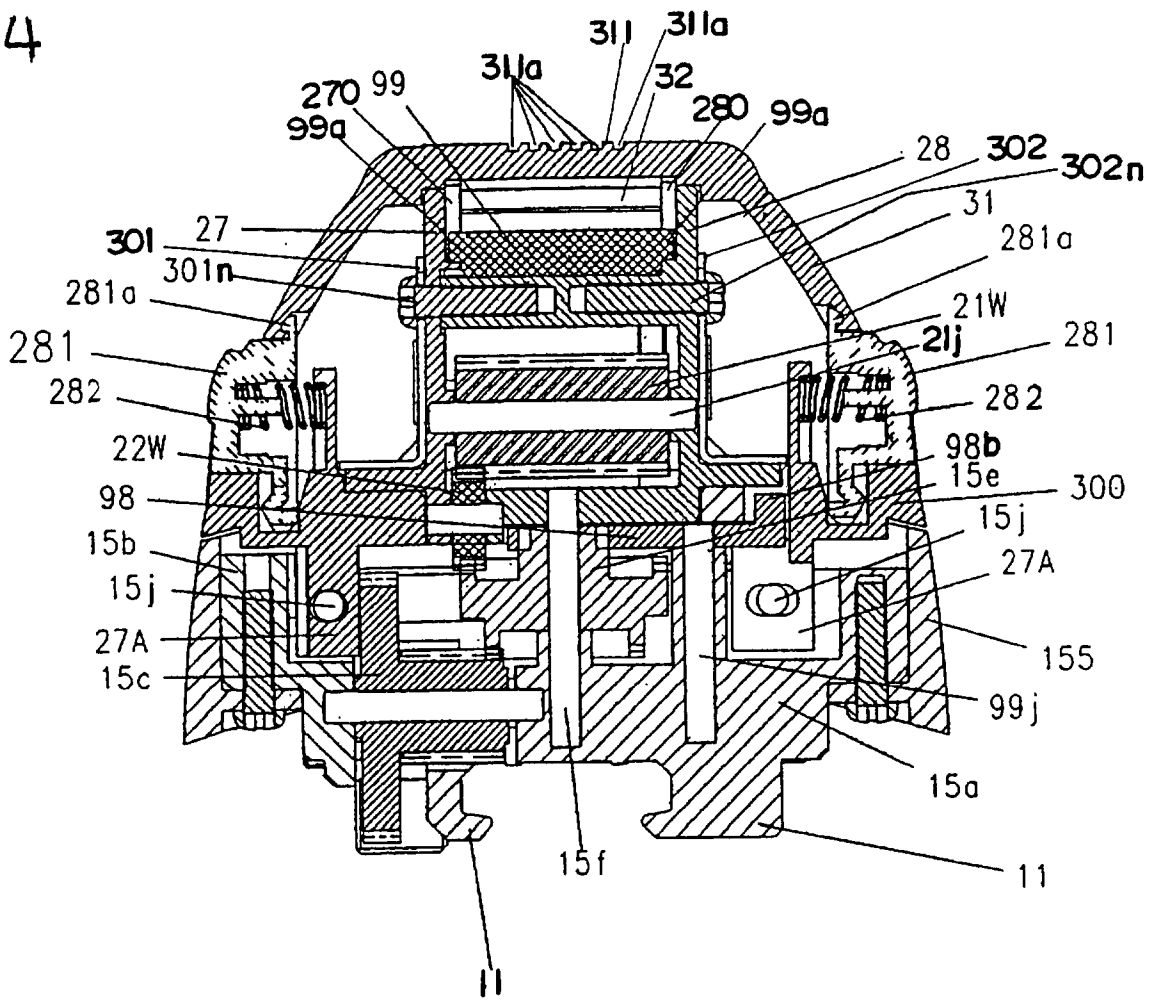
FIG. 24 is a cross-sectional view of a depilation head according to another embodiment of the invention.

FIG. 24 shows a depilating device according to another embodiment of the present invention. In the depilating device in FIG. 24, the head frame 31 in the depilation block 24 can be freely detached and attached, so that bits of hairs or flocks entered into the head frame 31 can be easily cleaned. In this embodiment, in order to have the head frame 31 freely detachable, hooks (281*a*, 281*a*) are provided at upper ends of push buttons 281, 281 which respectively have lower end portions engaging with concavities formed in the base 300. Also, notches for partly exposing the push buttons 281, 281 are provided at the side ends of the head frame 31. Then, the hooks (281*a*, 281*a*) are hooked on the inner surface of the head frame 31. The push buttons 281, 281 are pushed by resisting against return springs 282, 282, so that the push buttons 281, 281 are inclined while having the lower end sides of the push buttons 281, 281 as fulcrums. Accordingly, the engagement of the hooks (281*a*, 281*a*) with the head frame 31 is released, so that the head frame 31 can be detached.

The depilating device according to the embodiment of the present invention includes the plate for covering the external exposed surface of the rotating cylinder, and the slits extending in the direction substantially parallel to the rotational direction of the rotating cylinder are formed in the plate. Therefore, the much higher safety for the skin at the time of removing hairs can be secured by the plate described above. Furthermore, since the slits substantially parallel to the rotating direction of the rotating cylinder are provided in the plate, the hairs can be efficiently introduced. Also, both side walls of each slit presses the root of the hair, so that a portion of the hair buried in the skin is squeezed out and introduced into the slit, to be thereby pinched by the claws for removing hairs. Therefore, even the short hair can be securely removed.

In the depilating device according to the embodiment of the present invention, a plurality of claws provided on the rotating cylinder are arranged with the intervals in the direction of the rotational shaft of the rotating cylinder. Since the slits formed in the plate are arranged side by side in the direction of the rotational shaft with the substantially same interval as that of the claws, the hair introduced into any of the slits can be removed, resulting in the highly efficient depilation.

Since the pairs of claws provided on the rotating cylinder are opened and closed by the rods sliding in the shaft direction of the rotating cylinder, the hairs can be pinched at the outer periphery of the rotating cylinder, that is, at the position much closer to the skin surface. Therefore, much shorter hair can be removed by the depilating device of the embodiment.

The outer peripheral rims of the claws for depilation formed on the rotating cylinder are projected from the outer peripheral surface of the rotating cylinder. Therefore, it becomes easier to pinch much shorter hair by the depilating device of the embodiment, so that the efficiency of removing short hairs can be improved.

Since the outer peripheral rims of the claws for depilation elastically contacts the plate, the efficiency of removing short hairs can be further improved.

The plate includes the curved surface in accordance with the outer peripheral surface of the rotating cylinder. Therefore, not only when the hairs are removed from a relatively flat portion having a large area, such as a leg or an arm, but also when the hairs are removed from a concave portion, such as the armpit, the depilating device of the embodiment is easy to use. Also, when the depilating device is moved along the skin in order to remove the hairs, the forward portion of the slit is opened, so that the efficiency in introducing the hairs into the slits can be excellent.

Since the curved surface of the plate has a radius of curvature which is at least the radius of the rotating cylinder, the rotating cylinder can touch the plate internally, to thereby improve the ability of removing the short hairs.

Since the center of the curved surface of the plate coincides with the center of the rotation of the rotating cylinder, a condition, in which the claws for depilation are close to or in contact with the inner surface of the plate, can be secured in an extensive rotating range on the outer periphery of the rotating cylinder. Thus, the effective angle for removing the short hairs is large, and the depilation efficiency can be increased.

Since the plate is made of the thin metal plate, the rigidity of the plate can be made high while the thickness of the plate is small.

The thickness of the plate and the width of each slit formed in the plate are determined such that the skin is not protruded to the inner surface side of the plate when the outer surface of the plate is pressed against the skin surface. Therefore, if the very short hair is being removed, the hair can be pinched and pulled out by the claws without damaging the skin.

Since the width of each slit formed in the plate is substantially two to five times larger than the thickness of the plate, the hair can be pinched and pulled out by the claws without damaging the skin.

Also, the slit has a wide width at the forward end side in the moving direction of the depilation device along the skin surface when the depilation device is operated. Therefore, the efficiency in introducing the hairs into the slits can be increased.

The slit formed in the plate has a cross section taken along a line parallel to the rotational axis, the cross section having a width which decreases from an outer surface of the plate to an inner surface of the plate. Therefore, when the plate is pressed against the skin, the skin is easily introduced into the hole, so that the skin can be located near the inner surface of the plate, to thereby pinch the short hair.

The outer surface of the plate is provided with the comb including the comblike projections arranged side by side in the rotational shaft direction of the rotating cylinder. Therefore, the hairs can be combed by the comb, so that the efficiency in introducing the hairs into the slits can be increased.

Since the pitch of the comblike projection of the comb substantially agrees with the pitch or the interval of the slit in the plate, the effect of combing the hairs by the comb becomes further effective.

Since the comblike projections of the comb are located at the positions between the slits of the plate in the shaft direction of the rotating cylinder, the hairs combed by the comb can be more easily introduced into the slits.

The space between the distal ends of the comblike projections of the comb and the peak portion of the curved surface of the plate constitutes the concave space extending in the shaft direction of the rotating cylinder. Thus, the long hairs can be raised in the concave space, so that the depilating device also has the high depilation ability in removing the long hairs.

Since the outer surface of the plate is uneven to have the slight projections and concavities thereon, a contact area between the skin surface and the surface of the plate is made small when the depilating device is moved along the skin, so that the depilating device can be moved smoothly.

Also, in order to vibrate the plate in the direction substantially perpendicular to the rotational shaft of the rotating cylinder, the direction of vibrating the plate is set to be a direction separating the plate away from the skin. Accordingly, in case the depilating device is moved along the skin, the device can be smoothly moved.

The head frame for holding the plate and surrounding the rotating cylinder may be freely detachable. Therefore, it becomes easy to remove a hair caught inside the frame, resulting in a clean depilating device.

The depilating device according to the embodiment of the present invention includes a swinging mechanism for swinging the rotating cylinder around the axis of the direction perpendicular to the skin surface. Therefore, in case the depilation is carried out at the soft skin portion such as the armpit, due to the portion located on the swinging shaft in the rotating cylinder, the skin is reluctant to move together with the depilating device, resulting in improving the depilation efficiency. Also, if the swinging movement is the consistent cyclic movement, frictional resistance against the skin is made small, so that the usability can be also improved.

Since the swinging shaft is located at the center of the effective width of the rotating cylinder, the skin is further reluctant to move together with the depilating device. Therefore, the depilation efficiency can be increased, and the usability can be improved.

Since the entire depilation head holding the rotating cylinder and the gear for transmitting the rotation to the rotating cylinder is allowed to swing around the shaft, the swinging mechanism can be easily achieved.

Since the face gear coaxial to the swinging shaft is provided in the rotation transmission components from the driving unit to the depilation head, the transmission of the rotation to the rotating cylinder and the swinging mechanism can easily coexist.

Also, since the eccentric cam for driving the swinging movement is provided in the face gear, driving the swinging movement can be easily carried out.

The link arm, which engages with the eccentric cam and swings by the rotation of the eccentric cam, is connected to the depilation head freely rotatable around the swinging shaft, to thereby form the swinging mechanism. Thus, the pressing load by pressing the depilation device against the skin at the time of swinging movement can be made small. Also, the number of revolution is not lowered, so that the depilation efficiency is excellent.

The plate is located at the skin surface side of the depilation head, and swing together with the depilation head. Therefore, hairs introduced into the slits in the plate are not likely to be cut, and the hairs can be completely removed from the skin.

The shaft for preventing the disengagement of the depilation head in the direction substantially perpendicular to the shaft direction of the rotating cylinder and in the direction parallel to the skin surface is inserted into the depilation head. Therefore, assembling the depilation head is facilitated.

Obviously, numerous modifications and variations of the present invention are possible in light of the above teachings. It is therefore to be understood that within the scope of the appended claims, the invention may be practiced otherwise than as specifically described herein.

What is claimed is:

1. A depilating device comprising:

at least one rotating cylinder rotatable around a rotational axis;

at least one pair of depilating claws provided on a circumferential surface of the at least one rotating cylinder and configured to open and close to pinch and pull out hair due to a rotation of the at least one rotating cylinder;

a plate having an outer surface and inner surface which is configured to face the circumferential surface of the at least one rotating cylinder and having at least one slit through which the hair passes toward the circumferential surface of the at least one rotating cylinder, the slit extending along a substantially rotational direction of the at least one rotating cylinder, and the plate being attached to a head frame of the depilating device so that the plate prevents the at least one rotating cylinder from making contact with skin.

2. A depilating device according to claim 1, wherein the depilating device includes a plurality of pairs of depilating claws, the plurality of pairs of depilating claws being provided on the circumferential surface of the at least one rotating cylinder with a claw interval in a direction of the rotational axis, and wherein the plate includes a plurality of slits which are provided with a slit interval which is substantially same as the claw interval in a direction of the rotational axis.

3. A depilating device according to claim 1, further comprising:

a rod configured to move along a direction of the rotational axis to open and close the at least one pair of depilating claws.

4. A depilating device according to claim 1, wherein the at least one pair of depilating claws are provided on the circumferential surface of the at least one rotating cylinder such that the at least one pair of depilating claws projects from the circumferential surface of the at least one rotating cylinder.

5. A depilating device according to claim 4, wherein an outer periphery of the at least one pair of depilating claws elastically contacts the inner surface of the plate.

6. A depilating device according to claim 1, wherein the inner and outer surfaces of the plate are curved surfaces in accordance with the circumferential surface of the at least one rotating cylinder.

7. A depilating device according to claim 6, wherein the curved surfaces have a radius of curvature larger than a radius of the at least one rotating cylinder.

8. A depilating device according to claim 6, wherein the curved surfaces of the plate has a center which substantially coincides with a center of the at least one rotating cylinder.

9. A depilating device according to claim 1, wherein the plate is made of a metal plate.

10. A depilating device according to claim 1, wherein a thickness of the plate and a width of the slit is determined such that skin does not protrude from the inner surface of the plate toward the circumferential surface of the at least one rotating cylinder when the outer surface of the plate is pressed against the skin.

11. A depilating device according to claim 10, wherein the width of the slit is substantially two to five times larger than the thickness of the plate.

12. A depilating device according to claim 1, wherein a width of one end of the slit is larger than those of other portions of the slit.

13. A depilating device according to claim 1, wherein the slit has a cross section taken along a line parallel to the rotational axis, the cross section having a width which decreases from the outer surface of the plate to the inner surface of the plate.

14. A depilating device according to claim 1, wherein the plate comprises a comb provided on the outer surface of the plate, the comb including projections arranged along a direction of the rotational axis.

15. A depilating device according to claim 14, wherein the plate includes a plurality of slits which are provided with a slit interval along the direction of the rotational axis, and wherein a pitch of the projections is substantially same as the slit interval.

16. A depilating device according to claim 14, wherein the plate includes a plurality of slits which are provided with a slit interval along the direction of the rotational axis, and wherein the projections are positioned between the slits along the direction of the rotational axis.

17. A depilating device according to claim 14, wherein distal ends of the projections and top portion of the plate forms a concave space extending along the direction of the rotational axis.

18. A depilating device according to claim 1, wherein the outer surface of the plate is uneven.

19. A depilating device according to claim 1, further comprising:

a vibrator configured to vibrate the plate in a vibration direction substantially perpendicular to the rotational axis of the at least one rotating cylinder.

20. A depilating device according to claim 19, wherein the vibration direction is a direction in which the plate moves away from skin.

21. A depilating device according to claim 1, further comprising:

a main body housing; and a depilation head which contains the at least one rotating cylinder and to which the plate is attached, the depilation head being detachably attached to the main body housing.

22. A depilating device according to claim 1, further comprising:

a swinging mechanism configured to swing the at least one rotating cylinder around a swinging axis substantially perpendicular to skin surface.

23. A depilating device according to claim 22, wherein the swinging axis is located at a center of an effective width of the at least one rotating cylinder.

24. A depilating device according to claim 22, wherein the depilating device includes a plurality of rotating cylinders, and wherein the swinging axis is located at a center among the plurality of rotating cylinders.

25. A depilating device according to claim 22, further comprising:

a depilation head which contains the at least one rotating cylinder and at least one gear to transmit rotational power to the at least one rotating cylinder, the swinging mechanism being configured to swing the depilation head.

26. A depilating device according to claim 25, wherein a face gear is provided in a rotational power transmission from a driving source to the depilation head, a rotational axis of the face gear substantially coinciding with the swinging axis.

27. A depilating device according to claim 26, wherein a face gear includes an eccentric cam configured to swing the depilation head.

28. A depilating device according to claim 27, wherein the swinging mechanism includes a link arm which engages with the eccentric cam, the link arm being configured to swing the depilation head due to a rotation of the eccentric cam.

29. A depilating device according to claim 25, wherein the plate is provided at a skin surface side of the depilation head and configured to swing together with the depilation head.

30. A depilating device according to claim 25, further comprising:

a shaft configured to prevent a disengagement of the depilation head, the shaft being provided to be substantially perpendicular to the rotational axis of the at least one rotating cylinder and substantially parallel to the skin surface.

* * * * *